US007874630B2

(12) United States Patent
Hayashi

(10) Patent No.: US 7,874,630 B2
(45) Date of Patent: Jan. 25, 2011

(54) RECORDING SYSTEM HAVING A PLURALITY OF CONTROLLERS ARRANGED RESPECTIVELY FOR A PLURALITY OF RECORDING HEADS

(75) Inventor: Toshihiro Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 186 days.

(21) Appl. No.: 12/361,356

(22) Filed: Jan. 28, 2009

(65) Prior Publication Data

US 2009/0195570 A1 Aug. 6, 2009

(30) Foreign Application Priority Data

Jan. 31, 2008 (JP) ..... 2008-020349

(51) Int. Cl.
*B41J 29/38* (2006.01)
*B41J 2/155* (2006.01)

(52) U.S. Cl. ..... 347/9; 347/5; 347/12

(58) Field of Classification Search ..... 347/9, 347/12, 13

See application file for complete search history.

(56) References Cited

U.S. PATENT DOCUMENTS 4,608,575 A * 8/1986 Morgan ..... 347/5
5,354,135 A * 10/1994 Sakagami et al. ..... 347/5
5,606,349 A * 2/1997 Droit et al. ..... 347/9
5,833,375 A * 11/1998 Gauthier et al. ..... 358/1.15
6,027,195 A * 2/2000 Gauthier et al. ..... 347/9
7,778,562 B2 * 8/2010 Kurose et al. ..... 399/51
2007/0279449 A1 * 12/2007 Mori et al. ..... 347/9
2010/0073416 A1 * 3/2010 Yokota ..... 347/10
2010/0156972 A1 * 6/2010 Sakai ..... 347/9

FOREIGN PATENT DOCUMENTS

JP 11-245383 A 9/1999
JP 2006-263931 A 10/2006
JP 2007-069448 A 3/2007
JP 2007-229953 A 9/2007
JP 2009184142 A * 8/2009
JP 2009241379 A * 10/2009

* cited by examiner

*Primary Examiner*—Matthew Luu
*Assistant Examiner*—Shelby Fidler
(74) *Attorney, Agent, or Firm*—Sughrue Mion, PLLC

(57) ABSTRACT

A recording system for performing a recording operation on a target includes a plurality of recording heads, a plurality of controllers that are arranged respectively for the plurality of recording heads, a data distributor that distributes second data to each of the controllers, and a data generator that generates third data to be output to the plurality of recording heads in response to the second data. The second data results from dividing, by the number of recording heads, a first data to be supplied. The controller further includes a transfer unit that transfers the third data to be output to the recording head corresponding to another controller to the other controller and a verification unit that verifies that a recording start condition has been established.

4 Claims, 14 Drawing Sheets

RECORDING SYSTEM HAVING A PLURALITY OF CONTROLLERS ARRANGED RESPECTIVELY FOR A PLURALITY OF RECORDING HEADS

BACKGROUND

1. Technical Field

The present invention relates to a recording system including a plurality of recording heads, and a plurality of controller respectively controlling the recording heads, a recording apparatus, and a recording method of the recording apparatus.

2. Related Art

Ink jet printers are known as a recording apparatus. The ink jet printers are divided into a serial printer and a line printer by recording method. The serial printer moves a carriage having a recording head mounted thereon in a main scan direction in a reciprocating fashion, and then performs a printing operation on a recording sheet by ejecting ink drops on the sheet in the reciprocating movement (as disclosed in Japanese Unexamined Patent Application Publication No. 2007-229953).

One known type of line printer includes a plurality of recording heads arranged in a zigzag fashion so that nozzles covers the entire width of a large width recording sheet (as disclosed in Japanese Unexamined Patent Application Publication Nos. 2006-263931 and 2007-69448). Another known type of line printer includes a wide recording head extending across the entire width of a large width recording sheet (as disclosed in Japanese Unexamined Patent Application Publication No. 11-245383).

The printer having a plurality of recording heads has typically contained a single controller controlling the plurality of recording heads (as disclosed in Japanese Unexamined Patent Application Publication Nos. 2006-263931, 2007-69448, and 11-245383).

If a plurality of recording heads are arranged the known recording apparatuses as disclosed in Japanese Unexamined Patent Application Publication Nos. 2006-263931, 2007-69448, and 11-245383, the controller needs to perform a data generation process to generate ejection data for each recording head in accordance with a arrangement pattern of the recording heads and a data transfer process to sort the generated ejection data for each of the recording heads. The number of recording heads in use become large (as many as 10 heads or so, for example) in particular in a large-scale line printer. The data generation process for generating the ejection data for each recording head and the transfer process for sorting the ejection data for each recording head become complex. The design and manufacture of such a controller become a difficult task. Such a difficult task, which may be performed when the printer is modified or a new model is developed, becomes a burden in the development and manufacturing activity.

SUMMARY

An advantage of some aspects of the invention is that a large-scale modification in a controller resulting from a change in the number and arrangement pattern of recording heads and a recording method is eliminated. According to an aspect of the invention, a recording system for performing a recording operation on a target includes a plurality of recording heads, a plurality of controllers that are arranged respectively for the plurality of recording heads, a data distributor that distributes a second (distribution) data to each of the controllers, the second data resulting from dividing, by the number of recording heads, a first (record instruction) data to be supplied, and a data generator that generates a third (record) data to be output respectively to the plurality of recording heads in response to the second data, the controller includes a transfer unit that transfers the third data to be output to the recording head corresponding to another controller to the other controller, a verification unit that verifies that a record start condition is established, the record start condition is established in a state that a number of a transfer operation times has been reached a predetermined value, and an execution unit that causes the recording head to start executing the recording operation in response to the third data if the establishment of the record start condition is verified. The number of controllers is not limited to the number of recording heads. For example, one controller may correspond to two recording heads.

According to the aspect of the invention, the record instruction data is divided into the distribution data of the number of units equal to the number of recording heads, and each distribution data is then supplied to the respective controller. The process of generating the plurality of units of record data to be output respectively to the plurality of recording heads is performed in response to the distribution data. The transfer unit in the controller transfers the record data to be transferred to the recording head of the other controller, out of the plurality of units of record data, to the other controller. The verification unit in the controller verifies that the record start condition is established, the record start condition indicating that the transfer operation to start the recording operation has been completed. When the verification unit verifies that the record start condition has been established, the controller causes the recording head to start executing the recording operation. Once the record instruction data is supplied to the recording apparatus in accordance with the embodiment of the invention, the recording apparatus generates from the record instruction data the record data to be output to each recording head. The record data is thus transferred from controller to controller, and necessary record data thus reaches the controllers. The recording system can be easily configured by assembling a necessary number of component units, each component including a combination of the controller and the recording head. The recording system can thus avoid a large-scale modification in the controller resulting from a change in the number and arrangement pattern of recording heads and a recording method.

BRIEF DESCRIPTION OF THE DRAWINGS

The invention will be described with reference to the accompanying drawings, wherein like numbers reference like elements.

DESCRIPTION OF EXEMPLARY EMBODIMENTS

The embodiments of the invention are described below with reference to FIGS. 1-14.

Figure 1:
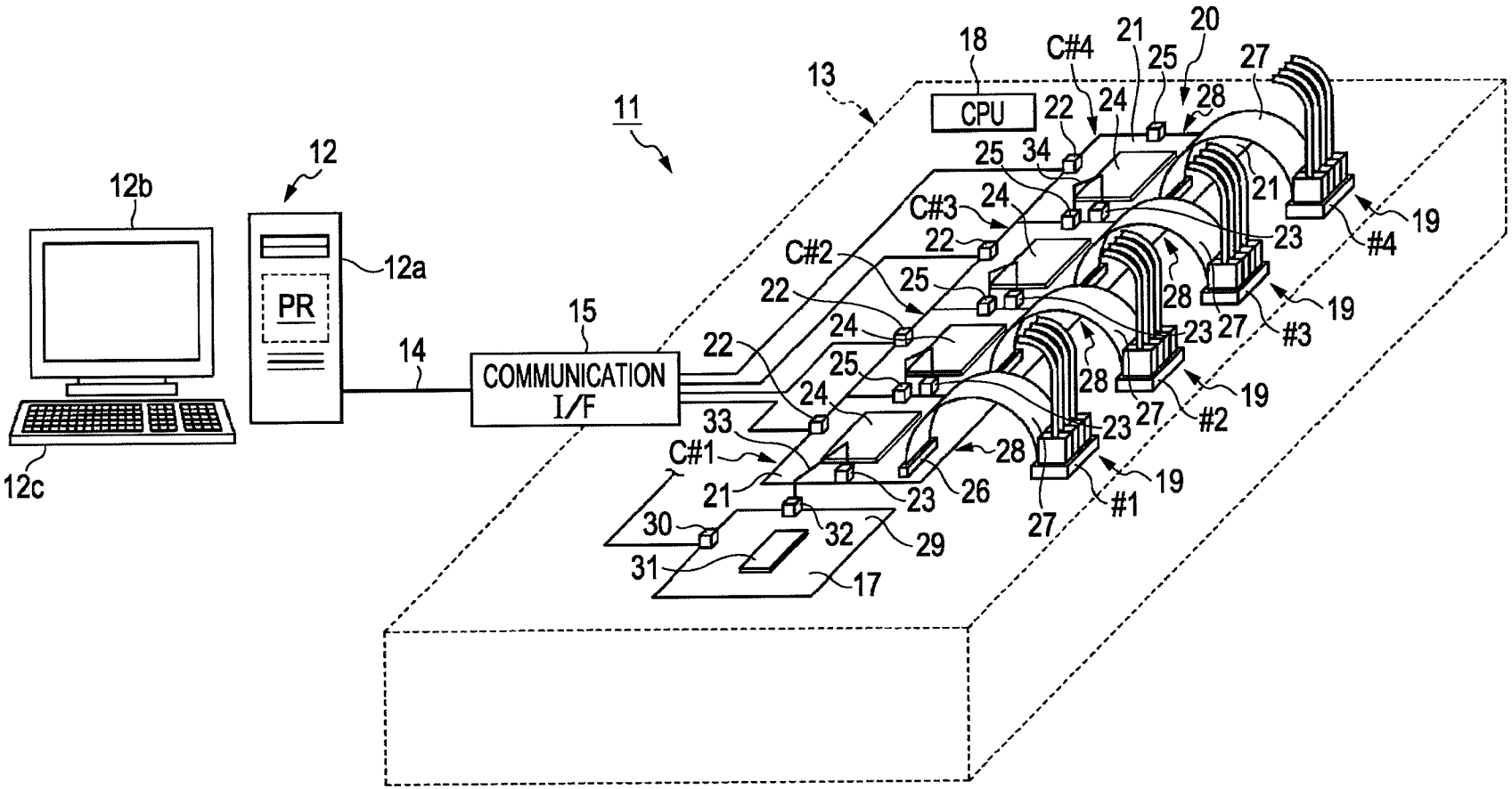
FIG. 1 is a perspective view of a printer system in accordance with one embodiment of the invention.

FIG. 1 is a perspective view of a printer system 11. The printer system 11 includes a host computer 12, and a printer 13 as a recording apparatus. The host computer 12 is connected to the printer 13 via a communication cable 14. The host computer 12 includes a main unit 12*a*, a display unit 12*b*, and an input unit 12*c*. The main unit 12*a* includes a printer driver PR. The printer driver PR acquires image data to be printed from image rendering software when a command to execute the printing of an image displayed on the display unit 12*b* is input with the input unit 12*c* operated. On a print condition input screen displayed on the display unit 12*b*, the printer driver PR performs an image process on the image data in accordance with print condition information the user inputs and specifies by operating the input unit 12*c*. The printer driver PR thus produces print data of the image. The print data thus produced is sent from the printer driver PR to the printer 13. The print data contains print image data (raster data) of a CMYK color system, print commands, etc.

The printer 13 receives the print data from the printer driver PR in the host computer 12 via a communication interface (I/F) 15. The print image data of the print data is sent to controllers C#1-C#n (n is a natural number equal to or greater than 2, and n is 4 in FIG. 1). In ejection drive control, the controllers C#1-C#n respectively control recording heads #1-#n that respond to the print image data. Each of the recording heads #1-#n include a plurality of row of nozzles on the underside thereof (nozzle opening surface). When the recording heads #1-#n are ejection drive controlled, ink drops are ejected through the nozzles. An image formed of ink dots is recorded on a recording sheet P (see FIGS. 6 and 10).

A head system 20 of the present embodiment includes the plurality (n) of the controllers C#1-C#n, a plurality of the recording heads #1-#n (four heads in FIG. 4) corresponding to the controllers C#1-C#n, and a synchronization controller 17 that outputs synchronization signals to the controllers C#1-C#n.

In accordance with the present embodiment, the communication interface 15 divides the print data into the distribution data of the same number as the number of controllers, and then distributes the distribution data to the controllers C#1-C#n, respectively. The distribution data distributed to the controllers C#1-C#n are transferred to a central processing unit (CPU) 18 in the printer 13. The CPU 18 generates ejection data of the recording heads #1-#n based on the distribution data from the controller C#k. An ejection data generation process is performed on a per distribution data unit basis from the controllers C#1-C#n. The ejection data units of the same number as the number of the recording heads #1-#n are then supplied back to the controllers C#1-C#n as the transfer sources of the distribution data.

The head system 20 is operable with each of a serial printer and a line printer. The head system 20 includes a plurality of head component units 19 and a single synchronization controller 17 in combination. Each head component unit 19 includes a controller C#k and a recording head #k in pairs. Even if the number of recording heads becomes different from type to type of the printer 13, the required number of head component units 19 meeting the required number of recording heads #1-#n can be assembled.

The printer driver PR of the host computer 12 sends the print data (record instruction data) on a per data unit basis so that the plurality of recording heads #1-#n perform a printing operation of each data unit. The printer 13 divides the print data into the distribution data units of the same number as the number of controllers, and then distributes the distribution data units to the controllers C#1-C#n.

The distribution data units SD1-SDn are transferred to the CPU 18 from the controllers C#1-C#n. The CPU 18 performs image processing using software, thereby generating ejection data Dk1-Dkm for m recording heads #1-#m ($m \leqq n$) that share the distribution data on the basis of a single unit of distribution data SDk (k=1, 2, . . . , n). The ejection data Dk1-Dkm generated is transferred back from the CPU 18 to the controller C#k as the distribution transfer source. Each of the controllers C#1-C#m performs a transfer process to transfer successively the ejection data of the remaining (m−1) controllers to a next controller in one direction. When a transfer operation value reaches a predetermined value after the first transfer operation, the ejection data is prepared in order to perform a first recording operation on the controller C#1 corresponding to the recording head #1 at the most upstream position in a transport direction. At this timing, the printing operation starts. A series of controllers C#1-C#m to which the ejection data is transferred are also referred to "transfer target controllers."

The head system 20 illustrated in FIG. 1 includes a plurality of head component units 19 that can commonly support the serial printer and the line printer. More specifically, the number of recording heads #1-#n becomes different depending on whether an ink jet printer works in accordance with a serial recording method or a line recording method, and the size of the printer (i.e., a maximum sheet size printable). The head system 20 is constructed by mounting the number of recording heads determined by these factors. The head component unit 19 includes one controller C#k for one recording head #k. If there is no need for identifying the individual controllers, each controller is referred to as a "controller C," and if there is no need for identifying the individual recording heads, each recording head is referred to as a "recording head #."

Figure 2:
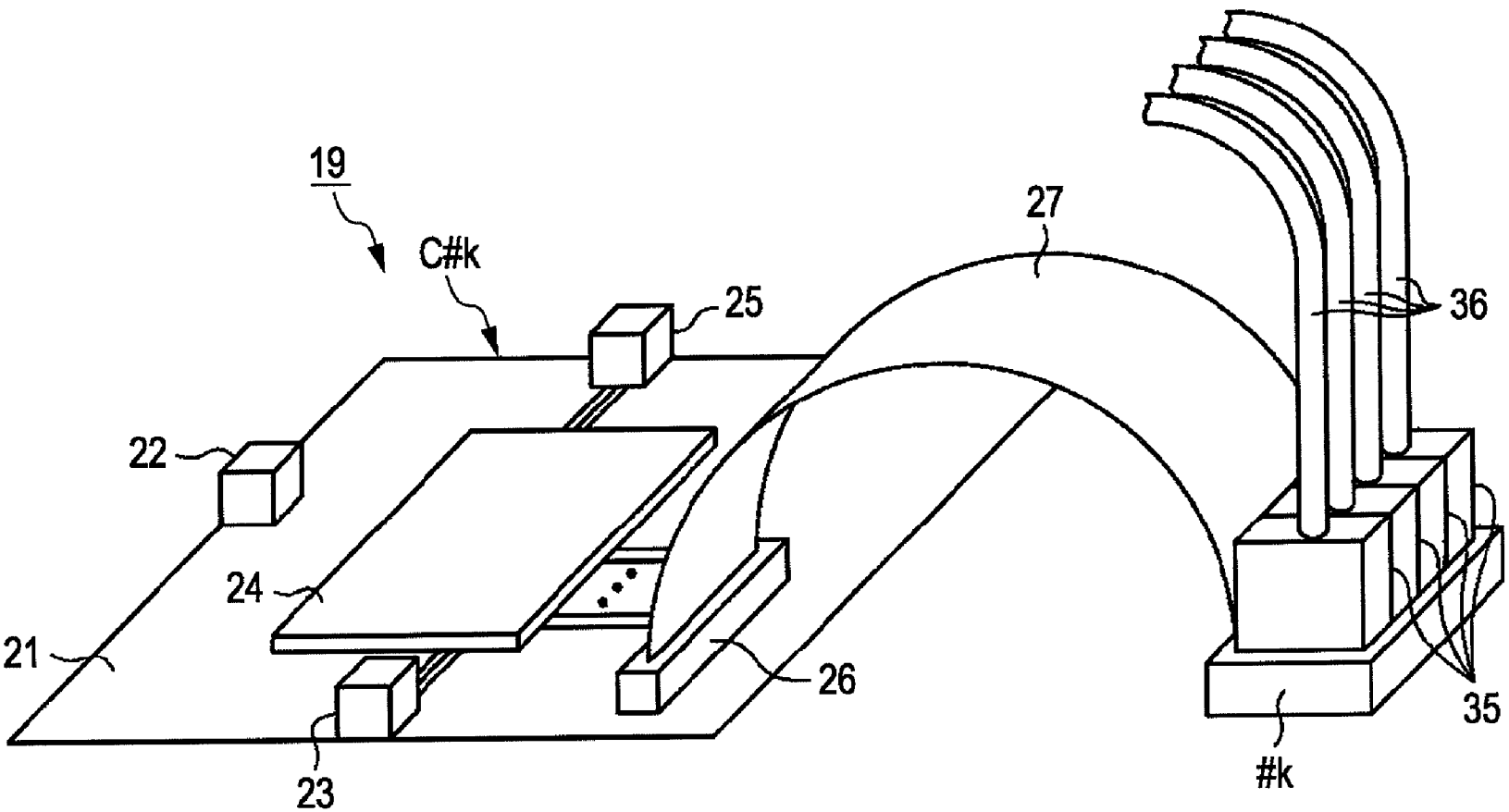
FIG. 2 is a perspective view diagrammatically illustrating a head component system.

FIG. 2 is a perspective view of the head component unit 19. With reference to FIGS. 1 and 2, the controller C includes a board 21, a print data receiving interface (herein after referred to as print data receiving I/F 22) mounted on the board 21, a receiving unit 23, a processor circuit 24, a transmitting unit 25, and a head interface (herein after referred to as "head I/F 26"). The recording head #k is electrically connected to the controller C#k with one end of a flexible wiring board 27 connected to a predetermined location of the recording head #k and the other end of the flexible wiring board 27 connected to the head I/F 26 on the board 21.

The processor circuit 24 outputs the ejection data to the corresponding recording head #k via the head I/F 26. The ejection data defines the ejection order of the recording heads #1-#n that eject ink drops through the nozzles thereof in order to render an image with dots in accordance with the print data. A buffer (to be discussed later) in the processor circuit 24 stores not only the ejection data for the recording head #k corresponding to the controller C#k but also the ejection data for the recording heads #1, #2, . . . , #k−1, #k+1, . . . , #n respectively corresponding to the other controllers C#1, C#2, . . . , C#k−1, C#k+1, . . . , C#n (n≧2).

As illustrated in FIG. 1, the transmitting unit 25 of each controller C#k (k−1, . . . , n) is connected to the receiving unit 23 of the adjacent controller C#k+1 (n+1 being 1) via a signal line 34 (bus line) as a transfer path so that data transfer to the adjacent controller C#k+1 is possible in one direction (in a transfer downward direction). The controller C#k performs the transfer process to transfer, out of n units of ejection data Dkj (j=1, . . . , n) stored on the buffer, the ejection data for the recording heads #1, #2, . . . , #k−1, #k+1, . . . , #n excluding own recording head #k, to the respective controllers C#1, C#2, . . . , C#k−1, C#k+1, . . . , C#n. In this way, the print data receiving I/F 22, the receiving unit 23, the processor circuit 24, the transmitting unit 25, and the head I/F 26 form a transfer unit 28.

The head system 20 also includes a single synchronization controller 17 on a per system basis. The synchronization controller 17 sends serially a synchronization signal S to the controllers C#1-C#n so that the controllers C#1-C#n perform simultaneously the data transfer process in one direction. The synchronization controller 17 includes a receiving unit 30, a synchronization circuit 31, and a transmitting unit 32, all mounted on a board 29. Upon receiving a synchronization signal generation command signal from the CPU 18 via the receiving unit 30, the synchronization circuit 31 generates a synchronization signal composed of a pulse signal having a predetermined period. The transmitting unit 32 is electrically connected to the receiving unit 23 in the controller C#1 arranged in the front of the bank of the controllers via the signal line 33. The transmitting unit 32 thus sends the synchronization signal to the receiving unit 23 in the controller C#1. The synchronization signal supplied to the controller C#1 is successively supplied to the controllers C#2-C#n via signal lines 34 that interconnect the controllers C#1-C#n with the transmitting unit 25 in one controller connected to the receiving unit 23 in the next controller. As illustrated in FIG. 1, the n recording heads #1-#n are simply linearly arranged. The recording heads #1-#n may be arranged in a predetermined pattern depending on whether the printer works in accordance with the serial recording method or the line recording method. The structure and process of the processor circuit 24 will be described in detail later.

As illustrated in FIG. 2, the recording head #k includes a plurality of sub tanks 35 (four sub tanks, for example) for ink colors (cyan (C), magenta (M), yellow (Y), and black (K)). An ink supply (not shown), such as an ink cartridge or ink tanks, supplies ink to sub tanks 35 via ink tubes. The ink is then further supplied to each recording head #k via a valve in each sub tank 35. A nozzle for each color allows the corresponding color ink drops to be ejected therethrough.

Figure 3:
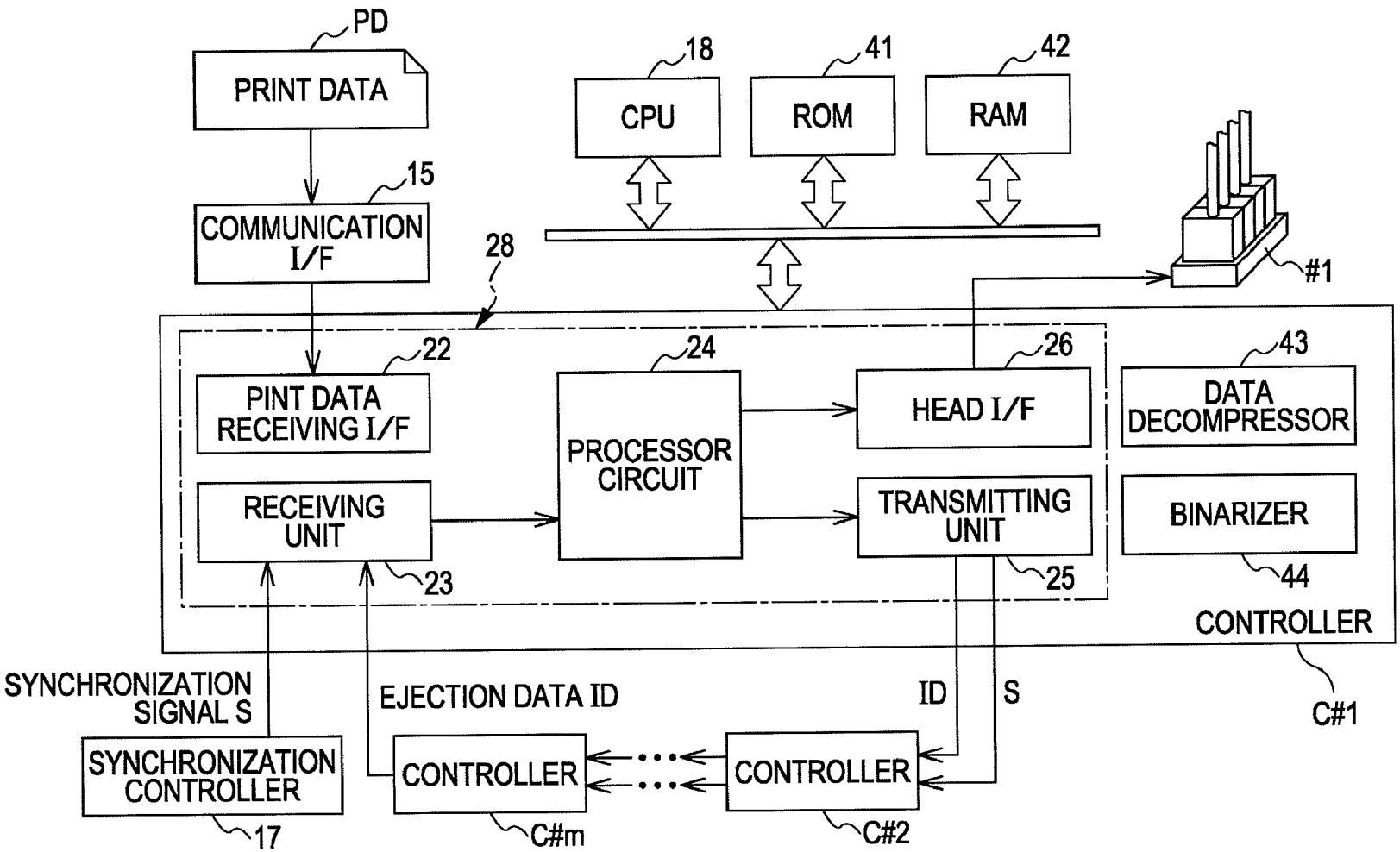
FIG. 3 is a block diagram illustrating an electrical structure of a printer.

FIG. 3 is a block diagram illustrating an electrical structure of a portion of the printer 13 related to head drive control. As illustrated in FIG. 3, the printer 13 includes the CPU 18, ROM 41, RAM 42, and n controllers C#1-C#n. The controller C is constructed of an application specific IC (ASIC), and includes a data decompressor 43 and a binarizer 44 in addition to the previously discussed transfer unit 28 including the print data receiving I/F 22, the receiving unit 23, the processor circuit 24, the transmitting unit 25, and the head I/F 26.

The print data received from the host computer 12 (see FIG. 1) is gradation data (raster data) based on RGB color system or CMYK color system. The print data PD is received by the communication interface 15 by predetermined data size as a transfer unit. The communication interface 15 divides a single unit of print data PD into n units of distribution data and then distributes the n units of distribution data to the n controllers C#1-C#n. In this case, the communication interface 15 may automatically distribute the print data PD to the controllers C#1-C#n in order by predetermined data size for each of the controllers C#1-C#n. Alternatively, the printer driver PR may send the print data PD containing a plurality of units of distribution data pre-addressed to the controllers C#1-C#n, and the communication interface 15 may distribute the distribution data to the controllers C#1-C#n in accordance with the addressing. Alternatively, the print data may be sent to all the controllers C#1-C#n and the controllers C#1-C#n may determine whether the print data is addressed to own controller, and then receive the print data if the print data PD is addressed to own controller. In the above examples, the own address identification function of each of (a) the communication interface 15, (b) the print data PD and the communication interface 15, and (c) the printer driver PR and own address verification function of the controllers C#1-C#n corresponds to the data distributor.

The printer 13 may receive as the print data PD the image data or the like, compressed in accordance with Joint Photographic Experts Group (JPEG) technique or runlength compression technique, from the host computer 12 or a mobile terminal (not shown). The data decompressor 43 decompresses the compressed data if the controller C has received such compressed data. The print data PD, if compressed data, may be decompressed by a decompressor arranged separate from the controllers C#1-C#n within the printer 13, and then the decompressed image data may be distributed to the controllers C#1-C#n by predetermined data size.

The controllers C#1-C#n corresponding to the recording heads #1-#m sharing the distribution data form a transfer target group among which the ejection data is transferred from one to another. The group of controllers as the transfer target group is one group only if the printer type is a serial printer (i.e., n=m). If the printer type is a line printer, N groups are used (i.e., n=Nm (N is a natural number equal to or greater than 2)).

The distribution data received by the controllers C#1-C#n is successively transferred to the CPU 18 as previously discussed. The CPU 18 performs a data generation process to generate the ejection data Dk1-Dkm for the recording heads #1-#m of the same group from the distribution data SDk received from the controller C#k. The CPU 18 repeats the data generation process by m times with the distribution data SDk (k=1, 2, . . . , m) changed, thereby generating the ejection data D11-D1*m*, D21-D2*m*, . . . , Dm1-Dmm for the recording heads #1-#m. If the controllers C#1-C#n are a plurality of groups, this process is repeated for each group.

The CPU 18 returns the ejection data Dk1-Dkm of the recording heads #1-#m generated from the same distribution data SDk to the controller C#k as the transfer source of the distribution data. The returned ejection data Dk1-Dkm is dot-rearrangement processed in accordance with the ejection order of the nozzles. In the case of a color image, the ejection data is generated for each of cyan, magenta, and yellow. A color conversion process to convert the image data in a predetermined color system obtained through the decomposition process to the CMYK color system is performed by the CPU 18 as part of the data generation process. The binarizer 44 binarizes the ejection data as CMYK dot data having continual gradation values.

The binarized ejection data is sent to the processor circuit 24. The processor circuit 24 selects the ejection data Dkk to be output to the recording head #k (k=1, 2, . . . , m) corresponding to own controller out of the ejection data Dk1-Dkm or the ejection data Dk1, . . . , Dkk−1, Dkk+1, . . . , Dkm to be output to the recording heads #1, . . . , #k−1, #k+1, . . . , #m (#2, . . . , #m if k=1) corresponding to the other controllers C#1, . . . , C#k−1, C#k+1, . . . , C#m out of the ejection data Dk1-Dkm. The controllers C#1-C#n belonging to the same group performs a relay transfer to transfer the ejection data from one controller to the next controller.

In accordance with the present embodiment, the ejection data contains in the header thereof an address of a destination controller. The ejection data to be transferred is selected by specifying the address while the address is shifted in descending order of the controller numbers, i.e., C#n→C#n−1→ . . . →C#2→C#1→#n. The transfer direction of the ejection data is set in ascending order of the controller number so that the ejection data is transferred in a circulation path in the direction of #1→#2→ . . . →#m→#1 in a relay transfer. When the transfer operation value reaches a predetermined value at which a record start condition is established, the recording heads #1-#n start the recording operation in response to the ejection data from the controllers C#1-C#n. Thereafter each time one operation of transfer is completed, the recording heads #1-#n perform the recording operation in response to next ejection data from the controllers C#1-C#n.

Figure 4:
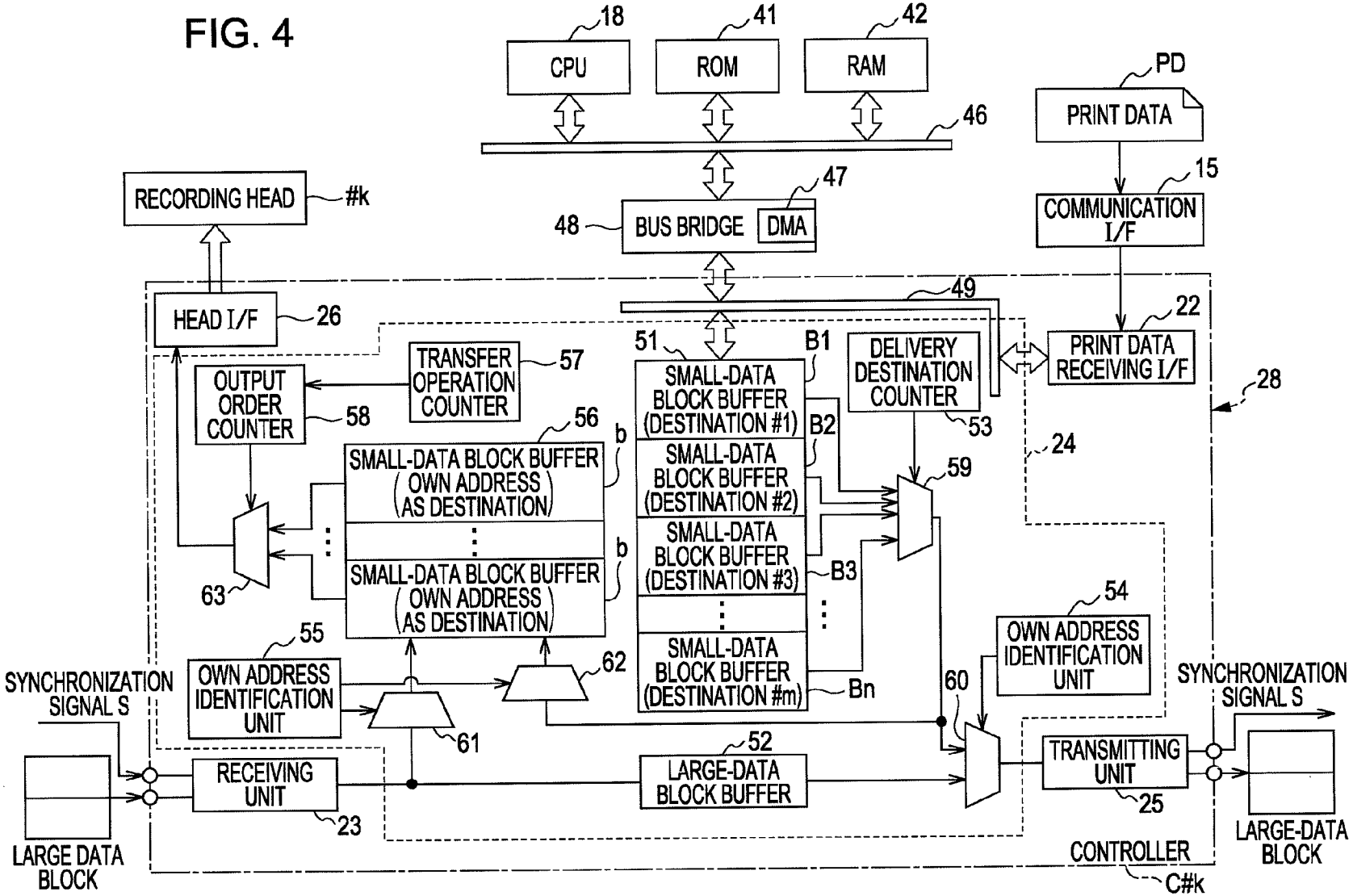
FIG. 4 is a block diagram illustrating in detail an electrical structure of a controller.

FIG. 4 illustrates a circuit structure of the transfer unit 28. As illustrated in FIG. 4, a bus 46 interconnected to the CPU 18, ROM 41, and RAM 42 is connected to a bus 49 in the controller C via a bus bridge 48 including a direct memory access (DMA) controller 47. The bus 49 in the controller C connects to the print data receiving I/F 22, the head I/F 26 and the processor circuit 24.

The processor circuit 24 includes a small-data block buffer 51, a large-data block buffer 52, a delivery destination counter 53, own address identification units 54 and 55, a small-data block buffer 56, a transfer operation counter 57, an output order counter 58, and a plurality of multiplexers 59-63. The delivery destination counter 53 and the multiplexer 59 form a transfer data selector. The own address identification unit 54 and the multiplexer 60 form a transfer data storage unit. The own address identification unit 55 and a plurality of multiplexers 61 and 62 form an own data acquisition unit. The transfer operation counter 57 forms a counter. The output order counter 58 and the multiplexer 63 form an execution unit.

The printer driver PR (see FIG. 1) in the host computer 12 sends to the printer 13 the print data PD by unit in accordance with the recording method of the printer 13. The communication interface 15 automatically distributes the received print data PD to each of the controllers C#1-C#n by predetermined size, starting with the header of the print data PD. The distributed print data PD is received by the controller C via the print data receiving I/F 22.

The distribution data received by the controller C#k is stored on a predetermined storage area (receiving buffer) of the RAM 42 corresponding to each of the controllers C#1-C#n via the bus 49 and the bus bridge 48. The CPU 18 then performs a predetermined program stored on the ROM 41, thereby generating the n units of ejection data Dk1-Dkm for the recording head from a single unit of distribution data SDk in a software process (ejection data generation process). The CPU 18 then attaches, to the respective ejection data Dk1-Dkm, headers, each header containing an address "#k" of a transfer source controller (hereinafter referred to as a transfer source address) and each of addresses "#1"-"#m" of transfer destination controllers (hereinafter referred to as a transfer destination address). The ejection data Dk1-Dkm have a data size corresponding to a single path or a plurality of lines, or a data size of a small-data block here. The ejection data Dk1-Dkm is returned to the controller C#k as the destination source of distribution data SDk. The transfer source address contained in the header of the ejection data Dk1-Dkm in the controller C#k specifies own address "#k."

If the print data PD is color image data, the ejection data Dk1-Dkm for each of the colors (C, M, Y, and K) is generated from distribution data SDk. FIG. 4 illustrates the circuit structure for single color ink ejection. In practice, one controller includes a circuit structure for four color ink ejection. The recording head #k is thus supplied with the ejection data on a per color basis. However, if the destination is designed to manage as one set of ejection data the ejection data for a plurality of colors, the structure illustrated in FIG. 4 can support color printing. In such a case, the controller C at the destination simply separates the ejection data into color data.

With reference to FIG. 4, the ejection data Dk1-Dkm returned to the controller C#k is stored onto the small-data block buffer 51. The small-data block buffer 51 includes m small-data block buffers for destinations #1-#m. The small-data buffer (hereinafter simply referred to as "small buffer Bk" (k=1, 2, . . . , m)). The CPU 18 instructs the DMA controller 47 to store the ejection data Dk1-Dkm on the small buffers B1-Bm corresponding to the destinations #1-#m.

The processor circuit 24 transfers the ejection data, out of the ejection data Dk1-Dkm stored on the small-data block buffer 51, to the destination controllers C#1, . . . , C#k−1, C#k+1, . . . , C#m. In response to the synchronization signal S, the controllers C#1-C#m concurrently transfer the ejection data to the next controllers thereof. The transfer operation is performed based on a packet of having a large-data block unit, accommodating two units of ejection data (small-data block) having a data size equal to one path of the recording head #k or a predetermined number of plurality of lines.

When the controllers C#1-C#m transfer the ejection data to the next controllers thereof in the concurrent transfer operation, the ejection data is sequentially relay-transferred from one controller to another by large-data block (two units of data). During the transfer process, the receiving unit 23 receives a large-data block equal to two small-data blocks while the transmitting unit 25 outputs a large-data block equal to two small-data blocks at the same time. The large-data block received by the receiving unit 23 is stored on the large-data block buffer 52.

The data stored on each of the small buffers B1-Bm is input to the multiplexer 59. The multiplexer 59 receives a selection signal from the delivery destination counter 53. The delivery destination counter 53 here outputs to the multiplexer 59 the selection signal indicating a destination according to which the ejection data to be transferred to another controller is selected. The multiplexer 59 selects and outputs the ejection data of the destination indicated by the selection signal. The delivery destination counter 53 sets an initial destination number to "m," and then decrements the destination number by one. When the destination number is decremented to a minimum destination number, the delivery destination counter 53 resets the destination number to "m." More specifically, the destination number for selecting the ejection data is changed in descending order of #m→#m−1→ . . . →#1→#m→ . . . . All the delivery destination counter 53 in the controllers C#1-C#m have the same setting. The change in the destination order is reverse to the transfer direction in which the ejection data is transferred through the controllers C#1-C#n (in ascending order of the controller numbers).

The multiplexer 60 arranged between the large-data block buffer 52 and the transmitting unit 25 receives the storage data (large-data block) of the large-data block buffer 52 and the output data from the multiplexer 59. The multiplexer 60 receives from the own address identification unit 54 a selection signal to block the outputting of the ejection data addressed to own address. For this reason, the multiplexer 60 blocks the outputting of the ejection data addressed to own address indicated by the selection signal, and allows the ejection data addressed to a number as an address different from own address to be output. The ejection data output from the multiplexer 60 is transmitted (transferred) from the transmitting unit 25 to the receiving unit 23 of the adjacent controller. It is noted that the ejection data blocked by the multiplexer 60 is deleted.

The two units of small-block data forming the same large-block data as the one received from the receiving unit 23 and then stored on the large-data block buffer 52 is supplied to the multiplexer 61. The multiplexer 62 receives the output data from the multiplexer 59. The multiplexers 61 and 62 receive selection signals from the own address identification unit 55. The multiplexers 61 and 62 output only the ejection data addressed to own address specified by the selection signals. The output ejection data addressed to own address is stored on the output buffer 56. The output buffer 56 includes a plurality of small-data block buffers for storing the ejection data for a plurality of own addresses (hereinafter referred to as "small buffer b").

The transfer operation counter 57 counts the transfer operations that are concurrently performed by the controllers C#1-C#n (transfer operation count value). When the transfer operation count value reaches a predetermined value, the transfer operation counter 57 outputs a countup signal to the output order counter 58. The transfer operation count value at which the ejection data for the first recording operation reaches the controller C# corresponding to the recording head # that is to perform the first recording is known beforehand. Set as a countup value on the transfer operation counter 57 is a transfer operation count value that is equal to or above that transfer operation count and that causes the ejection data for the controllers C#1-C#m to be transferred to the controllers C#1-C#m during an output period of the ejection data, the output period occurring each time the transfer operation is complete.

The delivery destination counter 53 has "m" set as an initial count (destination number) and then decrements the count thereof by one at a time. The delivery destination counter 53 thus changes the destination number in a direction (descending order) reverse to ascending order of the controller numbers. The controllers C#1-C#n perform the transfer process of the ejection data in such a destination order, thereby reducing the number of transfer operations prior to the start of the recording operation to a minimum possible number. Such a transfer process carries out an efficient relay transfer less susceptible to data stagnation in which the ejection data for a next recording operation fails to reach the controller C when the recording operation starts.

The initial value of the transfer operation counter 57 is set on a per controller basis on the controllers C#1-C#n. This is because the record start timings become different from position to position (from column to column) in the transport direction of the recording heads #1-#n. For example, the recording head #1 at the most upstream position in the transport direction starts first the recording operation, followed by the recording heads #2-#n at downstream positions in the transport direction. For this reason, the controller C starting recording earlier has a smaller countup value at the transfer operation counter 57 thereof. For example in accordance with the present embodiment, a countup value "m" is set at the transfer operation counter 57 in the controller C#1 corresponding to the recording head #1 at the most upstream position starting recording at the earliest timing. The lower position the recording head has in the downstream transport direction, the higher the countup value thereof becomes in steps of one.

Upon receiving the countup signal, the output order counter 58 starts outputting to the multiplexer 63 the selection signal selecting the ejection data to be output to the corresponding recording head #k. The transfer destination address and the transfer source address are attached to the header of the ejection data (small-data block) stored on the output buffer 56. The output order counter 58 is designed to count the transfer source address of the ejection data to be output next. In the present embodiment, the initial value of the output order counter 58 is "m." The initial value is decremented by "1" each time the multiplexer 63 outputs the ejection data. To attach the transfer source address to the ejection data, the processor circuit 24 may write own address to the header subsequent to the returning of the ejection data.

The multiplexer 63 receives the data stored on all the small buffers b forming the output buffer 56. The multiplexer 63 permits the ejection data having as the transfer source address the number selected by the selection signal, of the input data, to be output. The input timing of the selection signal from the output order counter 58 to the multiplexer 63 is synchronized at all the controllers C#1-C#n in response to the synchronization signal S. The outputting of next ejection data from the multiplexer 63 to the recording head #k via the head I/F 26 is concurrently carried out on all the controllers C#1-C#n. The outputting of the ejection data (small-data block) stored on the output buffer 56 starts when the transfer operation counter 57 outputs the countup signal. The ejection data is thus output in a predetermined output order in which the transfer source address is specified by the count on the output order counter 58 that decrements the count thereof, starting with "m."

The synchronization signal S from the receiving unit 23 is input to the multiplexers 59-63, etc. while being sent successively from the transmitting unit 25 to each controller C. In response to the synchronization signal S, each of the controllers C#1-C#n synchronizes the transfer timing of the ejection data to a next controller C with the output timing of the ejection data to the recording head #k.

The signal line 34 as a transfer path for interconnecting the controllers C#1-C#m (see FIG. 1) has a transfer speed defined by "(a predetermined transfer speed achieved between two controllers (transfer speed of the small-data block))×(number of transfer data controllers ("4" in FIG. 4))/2." The large-data block having a predetermined size to be transferred through the signal line 34 is divided into slots of the number equal to "the number of transfer target controllers/2" (2 slots in the present embodiment). Each slot accommodates a single unit of ejection data, and the large-data block (packet) having two slots can accommodate a maximum of two units of ejection data for transfer.

Figure 5:
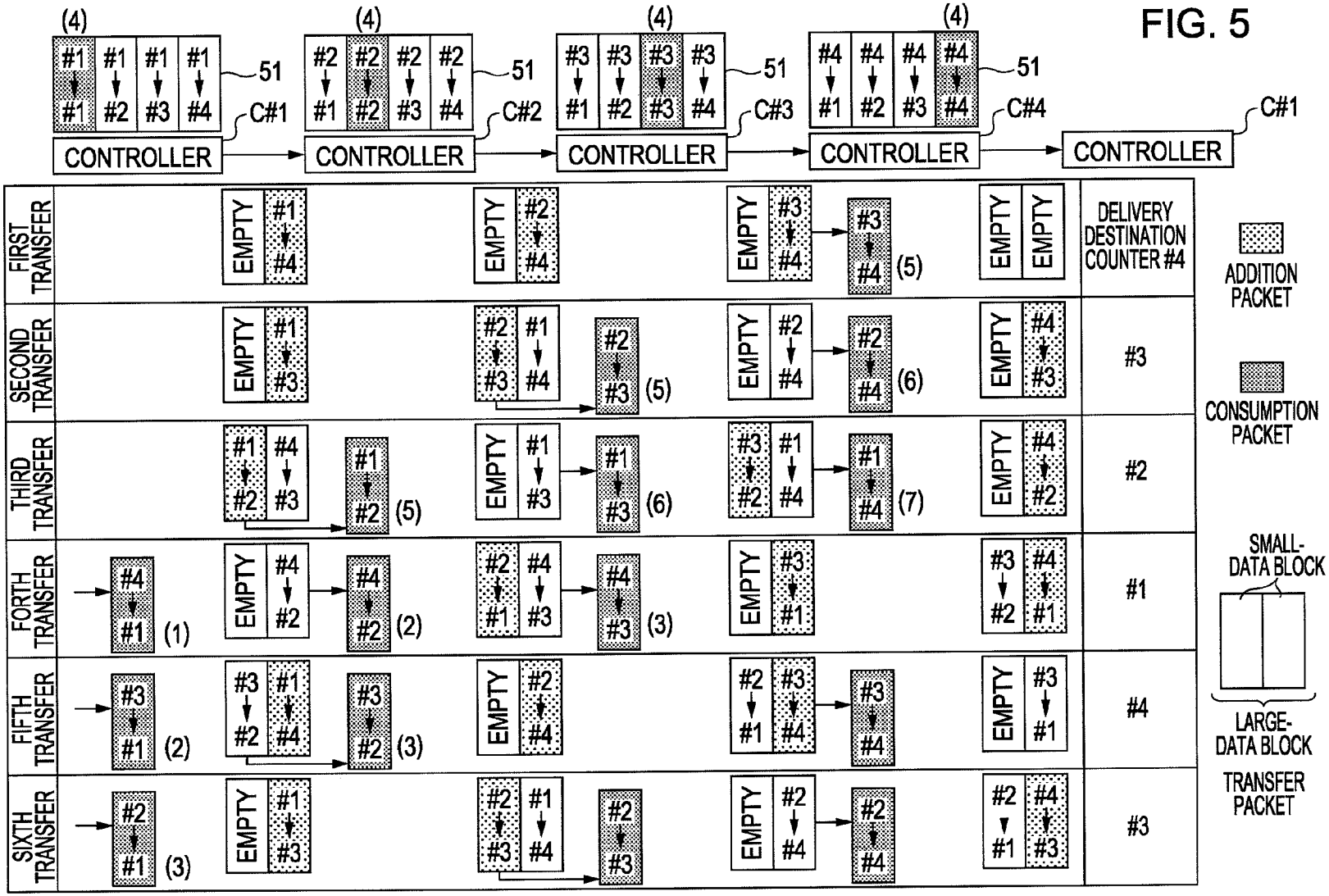
FIG. 5 is a timing diagram illustrating a relay transfer process.

FIG. 5 illustrates a relay transfer process of the ejection data performed between the transfer target controllers. With reference to FIG. 5, n controllers C#1-C#4 (n=4 in this case) are horizontally arranged in the transfer order, and the number of transfer operations is plotted in a vertical direction. FIG. 5 illustrates the relay transfer process in which the data transfer is performed in circulation in the order of "#1→#2→#3→#4→#1."

Illustrated at the topmost row in FIG. 5 is the ejection data stored on the small-data block buffer 51 in each of the controllers C#1-C#4. With reference to FIG. 5, the ejection data is denoted by numbers (transfer source address (own address) "#i" and transfer destination address (destination) "#j") and an arrow, i.e., "#i→#j." The transfer buffer 51 of the controller C#k stores four units of ejection data addressed to all the transfer target controllers, i.e., "#k→#1," "#k→#2," "#k→#3" and "#k→#4" (k=1, 2, . . . , m). The ejection data to be transferred is the one excluding the ejection data addressed to own address shadowed as illustrated in FIG. 5, i.e., "#1→#1," "#2→#2," "#3→#3" and "#4→#4."

With reference to FIG. 5, the transfer packet is a large-data block divisible into two slots, each slot accommodating the small-data block, and serves as transfer unit. The leftmost column of FIG. 5 lists counts (address numbers) at the delivery destination counter 53, and thus the ejection data to be transferred at this transfer operation is specified by the address number (count) as a destination. The counts at the delivery destination counters 53 of all the controllers have the same value, and each count is circulated in order as "#4→#3→#2→#1→#4→ . . . " as illustrated in FIG. 5 as the transfer operation advances. As illustrated in FIG. 5, an addition packet is denoted by a light-shadowed box and a consumption packet addressed to own address and extracted from the large-data block buffer 52 by the multiplexer 61 is denoted by a heavy-shadowed box.

At the initial state prior to the start of the recording operation, the large-data block of the large-data block buffer 52 contains two empty slots. At a first transfer operation, the delivery destination counter 53 counts the destination "#4." The delivery destination counter 53 downcounts the count thereof in a direction reverse to the order of the direction of the controller C (i.e., the transfer order), starting with "m." Referring to FIG. 5, the number of target controllers m is m=4, and the delivery destination counter 53 decrements the count thereof starting with "4," each time the transfer operation advances by "1." At the first transfer operation, the delivery destination counter 53 has the initial value of "4."

Each controller outputs the ejection data of the destination "4" from the transfer buffer 51 via the multiplexer 59. The ejection data is stores on an empty slot in the large-data block. The ejection data, if addressed to own address, is blocked by the multiplexer 60. For this reason, the controllers C#1-C#3 store the ejection data "#1→#4," "#2→#4," and "#3→#4" at the slots thereof, respectively. As for the controller C#4, the ejection data of the destination "#4" is addressed to own address, and the outputting of the ejection data is blocked by the multiplexer 60. The controller C#4 does not store the ejection data at the empty slot thereof. The packet of the large-data block is transferred at the first transfer operation to a right controller as illustrated in FIG. 5.

As a result of the first transfer operation, the ejection data "#3→#4" addressed to own address is extracted by the multiplexer 61 in the controller C#4 and then stored on the output buffer 56 as a consumption packet.

At a second transfer operation, the delivery destination counter 53 has "#3" as illustrated in FIG. 5. If the ejection data of the destination "#3" is not addressed to own address, each of the controllers C#1-C#n stores the ejection data of the destination "#3." The controllers C#1, C#2, and C#4 store the ejection data "#1→#3," "#2→#3," and "#4→#3" on the empty slots thereof, respectively. Since the ejection data of the destination "#3" is addressed to own address in the controller C#3, the multiplexer 60 blocks the outputting of the ejection data and no data is added to the empty slot in the controller C#3. The second transfer operation is thus performed to shift the packet of the large-data block to the respectively adjacent controller in the circulation path as shown in FIG. 5. As a result of the second transfer operation, the ejection data "#2→#3" addressed to own address received by the controller C#3 and the ejection data "#2→#4" addressed to own address received by the controller C#4 are extracted by the multiplexer 61 and then stored on the output buffer 56 as the consumption packets.

At a third transfer operation, the delivery destination counter 53 has "#2" as illustrated in FIG. 5. If the ejection data of the destination "#2" is not addressed to own address, each of the controllers C#1-C#n stores the ejection data of the destination "#2." The controllers C#1, C#3, and C#4 store the ejection data "#1→#2," "#3→#2," and "#4→#2" on the empty slots thereof, respectively. Since the ejection data of the destination "#2" is addressed to own address in the controller C#2, the multiplexer 60 blocks the outputting of the ejection data and no data is added to the empty slot in the controller C#2. The third transfer operation is thus performed to shift the packet of the large-data block to the respectively adjacent controller in the circulation path as illustrated in FIG. 5. As a result of the third transfer operation, the ejection data "#1→#2" addressed to own address received by the controller C#2, the ejection data "#1→#3" addressed to own address received by the controller C#3, and the ejection data "#1→#4" addressed to own address received by the controller C#4 are extracted by the multiplexer 61 and then stored on the output buffer 56 as the consumption packets.

At a fourth transfer operation, the delivery destination counter 53 has "#1" as illustrated in FIG. 5. If the ejection data of the destination "#1" is not addressed to own address, each of the controllers C#1-C#n stores the ejection data of the destination "#1." The controllers C#2, C#3, and C#4 store the ejection data "#2→#1," "#3→#1," and "#4→#1" on the empty slots thereof, respectively. Since the ejection data of the destination "#1" is addressed to own address in the controller C#1, the multiplexer 60 blocks the outputting of the ejection data and no data is added to the empty slot in the controller C#1. The fourth transfer operation is thus performed to shift the packet of the large-data block to the respectively adjacent controller in the circulation path as illustrated in FIG. 5. As a result of the fourth transfer operation, the ejection data "#4→#1," "#4'#2," and "#4→#3" addressed to own addresses and respectively received by the controllers C#1, C#2, and C#3 are extracted by the multiplexer 61 and then stored on the output buffer 56 as the consumption packets.

At a fifth transfer operation, the delivery destination counter 53 has "#4" as illustrated in FIG. 5. If the ejection data of the destination "#4" is not addressed to own address, each of the controllers C#1-C#n stores the ejection data of the destination "#4." The controllers C#1, C#2, and C#3 store the ejection data "#1→#4," "#2→#4," and "#3→#4" on the empty slots thereof, respectively. Since the ejection data of the destination "#4" is addressed to own address in the controller C#4, the multiplexer 60 blocks the outputting of the ejection data and no data is added to the empty slot in the controller C#4. The fifth transfer operation is thus performed to shift the packet of the large-data block to the respectively adjacent controller in the circulation path as illustrated in FIG. 5. As a result of the fifth transfer operation, the ejection data "#3→#1," "#3→#2," and "#3→#4" addressed to own addresses and respectively received by the controllers C#1, C#2, and C#4 are extracted by the multiplexer 61 and then stored on the output buffer 56 as the consumption packets.

At a sixth transfer operation, the delivery destination counter 53 has "#3" as illustrated in FIG. 5. If the ejection data of the destination "#3" is not addressed to own address, each of the controllers C#1-C#n stores the ejection data of the destination "#3." The controllers C#1, C#2, and C#4 store the ejection data "#1→#3," "#2→#3," and "#4→#3" on the empty slots thereof, respectively. Since the ejection data of the destination "#3" is addressed to own address in the controller C#3, the multiplexer 60 blocks the outputting of the ejection data and no data is added to the empty slot in the controller C#3. The sixth transfer operation is thus performed to shift the packet of the large-data block to the respectively adjacent controller in the circulation path as illustrated in FIG. 5. As a result of the sixth transfer operation, the ejection data "#2→#1," "#2→#3," and "#2→#4" addressed to own addresses and respectively received by the controllers C#1, C#3, and C#4 are extracted by the multiplexer 61 and then stored on the output buffer 56 as the consumption packets.

A similar relay transfer operation is repeated. In the course of the relay transfer operation, the transfer operation counter 57 counts the transfer operations. When the transfer operation values reaches a predetermined Gk of each of the controllers C#1-C#m, the transfer operation counter 57 outputs the countup signal to the output order counter 58. The output order counter 58 in turn starts outputting to the multiplexer 63 the selection signal specifying the number as the transfer source address of the ejection data to be output. The output order of the numbers as the transfer source addresses is common to all the controllers C#1-C#n. In the present embodiment, the output order that the output order counter 58 specifies with the selection signal is cycled through "#4→#3→#2→#1→#4→ . . . ," starting with "#4" as an initial value. The number indicating the output order is updated each time the transfer operation advanced by "1," i.e., each time the multiplexer 63 output the ejection data. The ejection data (small-data block) having the number as the transfer source address is output from the multiplexer 63.

The predetermined value Gk of the transfer operation counter 57 is set on per controller basis. In the present embodiment, the predetermined value Gk of the transfer operation counter 57 in the controller C#k is set to be G=k+3. For example, the predetermined value Gk of the transfer operation counter 57 is G1=4 in the controller C#1, G2=5 in the controller C#2, G3=6 in the controller C#3, and G4=7 in the controller C#4. When the transfer operation counter 57 counts the predetermined value Gk, the ejection data is output to the corresponding recording head #k, and the recording operation of the recording head #k is thus started.

In FIG. 5, each parenthesized number next to each consumption packet refers to the number of recording operations. The number of recording operations indicates how many recording passes have been carried out in the case of the serial printer, and how many recording operations have been performed with a predetermined plurality of number of lines treated as unit in the case of line printer.

When the fourth transfer operation is complete as illustrated in FIG. 5, the transfer operation counter 57 in the controller C#1 reaches the predetermined value G1=4, and counts up. The output order counter 58 outputs the initial value "#4" as the selection signal to the multiplexer 63. At this moment, the transfer operation counters 57 in the other controllers C#2-C#4 have not reached the predetermined values G2(=5), G3(=6), and G4(=7) yet. As a result, when the fourth transfer operation is complete, the controller C#1 outputs to the recording head #1 the ejection data "#4→#1" (the ejection data with "(1)" attached thereto), and a first recording operation is thus performed.

When the fifth transfer operation is complete, the transfer operation counter 57 in the controller C#2 reaches the predetermined value G2=5, and counts up. The output order counter 58 outputs the initial value "#4" as the selection signal to the multiplexer 63. At this moment, the output order counter 58 in the controller C#1 outputs to the multiplexer 63 the transfer source address "#3" as the selection signal. As a result, when the fifth transfer operation is complete, the controllers C#1 and C#2 output the ejection data "#3→#1" and "#4→#2" (the ejection data with "(2)" attached thereto), respectively. A second recording operation is thus performed.

When the sixth transfer operation is complete, the transfer operation counter 57 in the controller C#3 reaches the predetermined value G3=6, and counts up. The output order counter 58 outputs the initial value "#4" as the selection signal to the multiplexer 63. At this moment, the output order counters 58 in the controllers C#1 and C#2 output to the multiplexers 63 the transfer source addresses "#2" and "#3" as the selection signals, respectively. As a result, when the sixth transfer operation is complete, the controllers C#1, C#2, and C#3 output the ejection data "#2→#1," "#3→#2," and "#4→#3" (the ejection data with "(3)" attached thereto), respectively. A third recording operation is thus performed.

Similarly, when the seventh transfer operation is complete, the controllers C#1-C#4 output the ejection data "#1→#1," "#2→#2," "#3→#3," and "#4→#4", respectively, and a fourth recording operation is performed. When the eighth transfer operation is complete, the controllers C#1-C#4 output the ejection data "#4→#1," "#1→#2," "#2→#3," and "#3→#4", respectively, and a fifth recording operation is performed. When the ninth transfer operation is complete, the controllers C#1-C#4 output the ejection data "#3→#1," "#4→#2," "#1→#3," and "#2→#4", respectively, and a sixth recording operation is performed. Each time the transfer advances by "one operation," the controllers C#1-C#n output the ejection data and the recording heads #1-#4 perform the recording operation.

Each recording head #k receives an ejection timing signal generated in response to an encoder pulse signal, and selects between ejection and no-ejection in response to the ejection data when it is predetermined ejection timing responsive to the ejection timing signal. At the recording head #k, a voltage having an ejection drive waveform is supplied to an ejection element corresponding a nozzle that is to eject ink. An ink drop is then ejected through the nozzle.

Each of the serial printer and the line printer having the head system 20 of this embodiment incorporated is described below. The printer 13 as a serial printer is described first with reference to FIGS. 6-9.

Serial Printer

Figure 6:
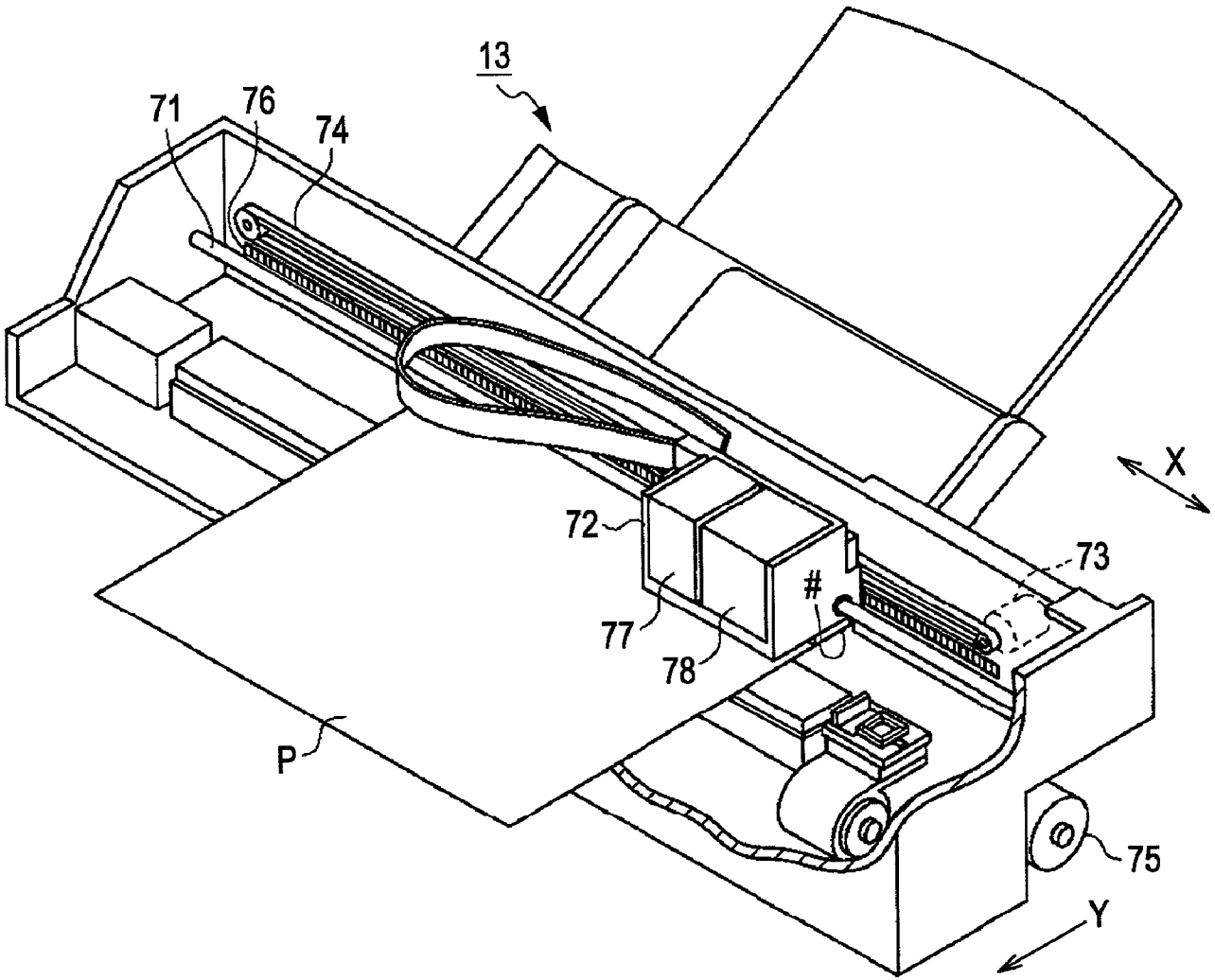
FIG. 6 is a perspective view of a serial printer.

FIG. 6 is a perspective view of the printer 13. With reference to FIG. 6, the printer 13 as a serial printer includes a recording head # mounted on the underside of a carriage 72 that is movable in a main scan direction X along a guide shaft 71. A printing operation and a paper transport operation are alternately performed while the carriage 72 on a timing belt 74, driven by a carriage motor, moves in a reciprocating movement in the main scan direction X. In the printing operation, the recording head #k ejects ink drops to a recording paper sheet P. In the paper transport operation, the recording paper sheet P is transported at a paper transport pitch in a transport direction Y (sub-scan direction) by a paper transport motor 75. The position of the carriage 72 is determined by counting the output pulses of a linear encoder 76. The carriage 72 is speed-controlled by controlling the carriage motor 73 to a target speed matching the position of the carriage 72. The ejection timings of nozzles of the recording head #k for ejecting ink supplied from in cartridges 77 and 78 are determined in response to an ejection timing signal generated from the output pulses from the linear encoder 76.

Figure 7:
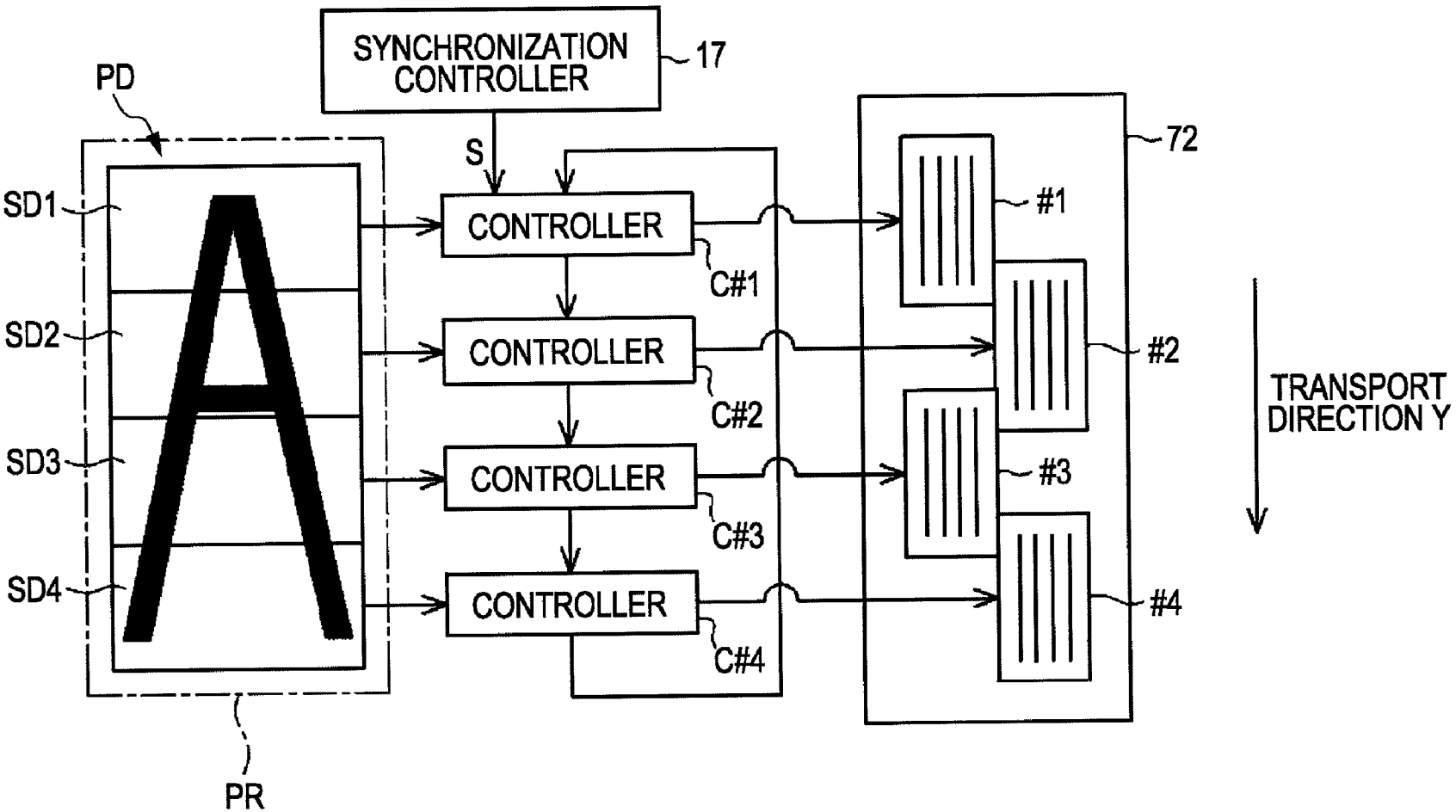
FIG. 7 is a block diagram illustrating the head component system of the serial printer.

FIG. 7 illustrates the layout of recording heads and a data distribution method in the serial printer.

Referring to FIG. 7, a plurality of recording heads #1-#4 (four recording heads) are arranged in a zigzag configuration on the carriage 72 of the serial printer, shifted in the transport direction Y of the recording paper sheet P.

The serial printer works in an interlace printing interlace (dot complement recording method). In the dot complement recording method, the predetermined number of nozzles at predetermined intervals, out of a group of nozzles arranged in the paper transport direction, are used in a predetermined main scan line formation order so that adjacent lines out of a plurality of main scan lines printed on the recording paper sheet P are not always formed by the same combination of nozzles. The main scan line herein refers to a group of dots traced in a main scan direction and generated by a single nozzle. The main scan line can also be referred to as a raster line. In the interlace printing method, a first recording head records main scan lines (in a first pass), a second recording head records main scan lines (in a second pass) in a line space left by the first recording head, and so on so that the four recording head #1-#4 complement each other in recording the main scan lines in line spaces. An image is thus formed of four main scans (four passes). Since the four recording heads #1-#4 record the main scan lines in different rows of a single image in the interlace printing method, the ejection data of each recording head is generated based on the common print data PD.

The print data PD is sent to the printer 13 from the printer driver PR in the host computer on a per unit basis. The communication interface 15 divides the print data PD into the distribution data SD1-SD4 in accordance with the layout position of the recording heads #1-#n, and then distributes the distribution data SD1-SD4 to the corresponding controllers C#1-C#4.

As previously discussed, the communication interface 15 may automatically distribute the print data PD by predetermined data size at a time, or the printer driver PR may send pre-divided data to each of the controllers C#1-C#n. The distribution data SD1-SD4 is thus distributed to the controllers C#1-C#4. In a stand-alone type printer, the print data PD is generated from the image data in an internal process, and one unit of print data is distributed to each of the controllers C#1-C#n.

The controllers C#1-C#4 transfer the received distribution data to the CPU 18 (see FIGS. 1, 3, and 4). In an ejection data generation process, the CPU 18 generates ejection data for the recording head #1-#4 based on the distribution data. More specifically, the CPU 18 generates four units of ejection data D11-D14 from the distribution data SD1, four units of ejection data D21-D24 from the distribution data SD2, four units of ejection data D31-D34 from the distribution data SD3, and four units of ejection data D41-D44 from the distribution data SD4. In this case, the CPU 18 attaches a header containing the transfer source address and the transfer destination address to each of the ejection data Dk1-Dk4 (k=1, . . . , 4). In designate Dij representing the ejection data, the letter "i" represents the transfer source address "#i" and the letter "j" represents the transfer destination address "#j."

Four generated units of ejection data Dk1-Dk4 are sent to the controller C#k as the transfer source by the CPU 18, and then stored on the transfer buffer 51 (see FIG. 1).

The controller C#k (k=1, . . . , 4) performs the relay transfer operation to transfer three units of ejection data Dkj (k≠j) addressed to the other address in directions denoted by arrows in FIG. 7. The transmitting unit 25 in the controller C#4 corresponding to the recording head #4 arranged at the most downstream position in the transport direction is connected to the receiving unit 23 in the first controller C#1 corresponding to the recording head #1 at the most upstream position in the transport direction via the signal line 34 identical to the one illustrated in FIG. 1. In order to perform the interlace printing, the ejection data D21, D31, and D41 generated from the distribution data SD2-SD4 excluding the distribution data for the most upstream position is transferred to the first controller C#1 via the lower terminal controller C#4.

The relay transfer is performed as illustrated in FIG. 5. The transfer buffer 51 in the controller C#k stores four units of ejection data #k→#1, #k→#2, #k→#3, and #k→#4. The delivery destination counter 53 changes the count thereof in order of #4→#3→ . . . →#1→#4→ . . . . The rest of the transfer rule is identical to the previously discussed one. In this case, the recording operation is started when four transfer operations have been completed. The ejection data is sent to the recording heads #1-#4 each time one transfer operation is complete. The carriage 72 starts moving, and ink drops are then ejected from the recording heads #1-#6 at the moment it is an ejection timing in the middle of movement of the carriage 72. The printing operation alternates with the paper transport operation of the recording paper sheet P.

Figure 8:
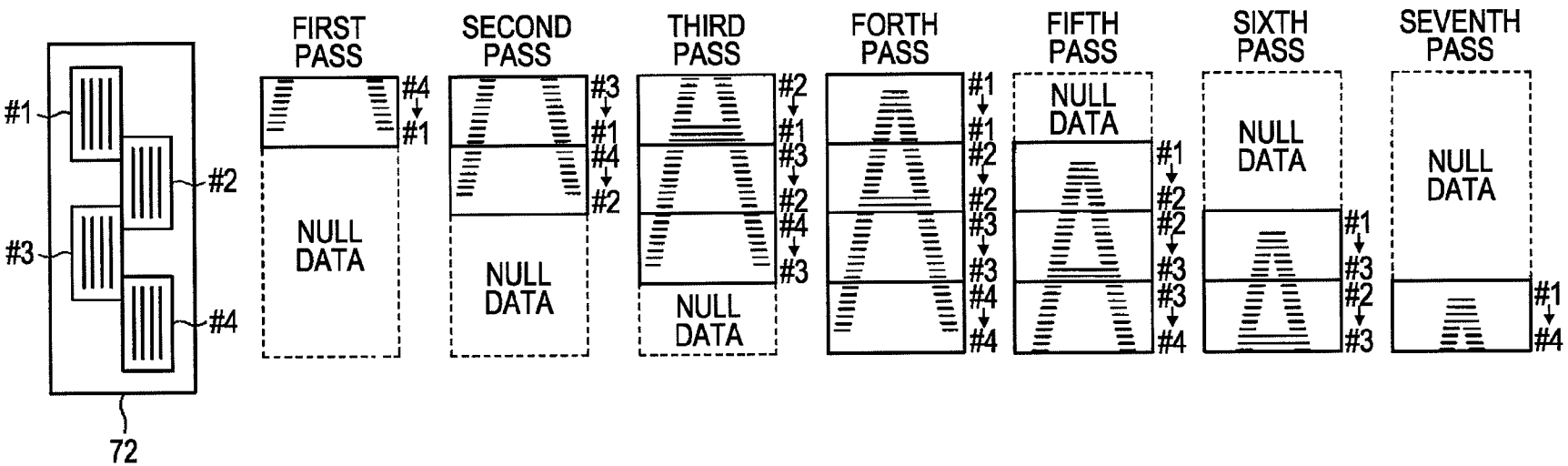
FIG. 8 diagrammatically illustrates a transfer process of ejection data in the serial printer.

FIG. 8 diagrammatically illustrates the ejection data to be sent to the recording heads #1-#4 in the relay transfer process with the ejection data in association with each head. When the ejection data "#4→#1" reaches the controller C#1 in the data transfer, the recording head #1 performs an ejection operation based on the ejection data "#4→#1" in a first pass.

The ejection data "#3→#1" is transferred to the controller C#1 and the ejection data "#4→#2" is transferred to the controller C#2. In a second pass, the recording head #1 performs the ejection operation based on the ejection data "#3→#1" and the recording head #2 performs the ejection operation based on the ejection data "#4→#2." More specifically, the recording head #k having received the ejection data "#4→#k" having #4 as the transfer source address performs the ejection operation at a first pass thereof. The recording head #k having received the ejection data "#3→#k" having #3 as the transfer source address performs the ejection operation at a second pass thereof. The recording head #k having received the ejection data "#2→#k" having #2 as the transfer source address performs the ejection operation at a third pass thereof. The recording head #k having received the ejection data having #1 as the transfer source address performs the ejection operation at a fourth pass thereof (final pass of one cycle). As a result of the relay transfer, the recording heads successively receive the ejection data as illustrated in FIG. 8.

Figure 9:
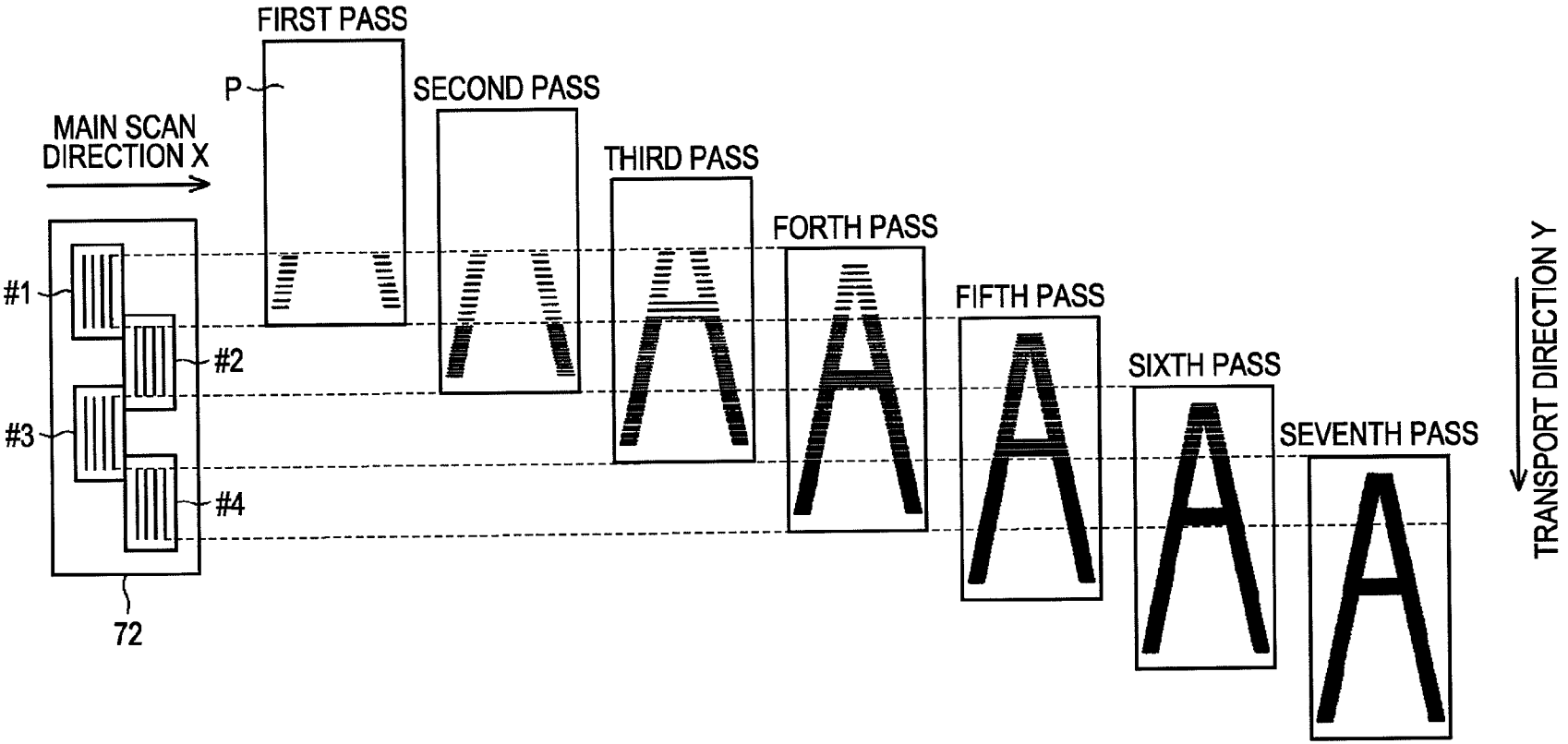
FIG. 9 diagrammatically illustrates a printing process of the serial printer.

The ejection operation is performed at each pass in accordance with the ejection data illustrated in FIG. 8 that has been circulated across the recording heads #1-#4 in the relay transfer. The printing operation is thus performed as illustrated in FIG. 9. In the meantime, the recording paper sheet P is transported in the transport direction Y in an intermittent fashion. The scan operation of the carriage 72 in the main scan direction X is alternately performed with the paper transport operation. In the course of the scan operation, the recording heads #1-#4 eject ink drops in response to the ejection data. The printing of the image on recording paper sheet P is thus in progress as illustrated in FIG. 9. The printing of the image on the recording paper sheet P is complete by seven passes.

Line Printer

The printer 13 as a line printer is described below with reference to FIGS. 10-14.

Figure 10:
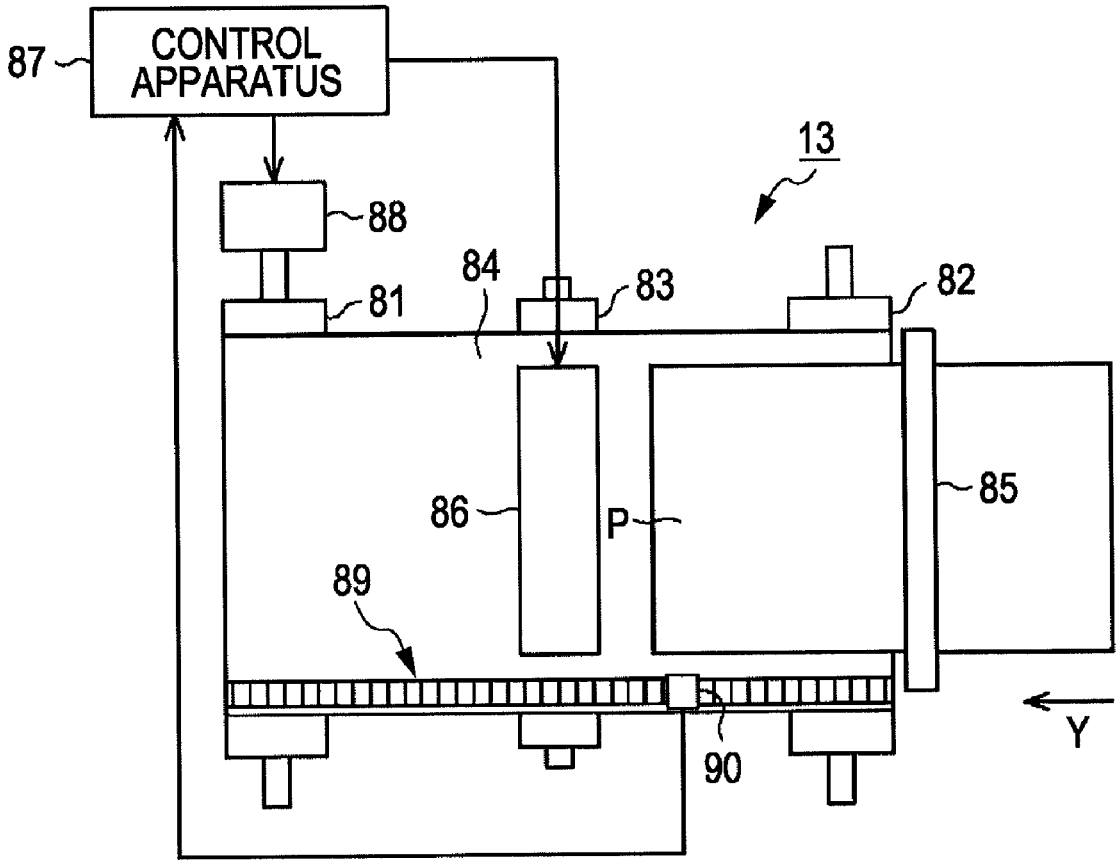
FIG. 10 is a plan view of a line printer.

FIG. 10 is a plan view diagrammatically illustrating the line printer. In the printer 13 as a line printer as illustrated in FIG. 10, a recording paper sheet P is transported by a roller 85 on a transport belt 84 wrapped around a plurality of rollers 81-83. A recording unit 86 is arranged above the generally central portion of the belt surface of the transport belt 84

(above in a direction perpendicular to the plane of the page of FIG. 10) with a predetermined gap maintained therebetween. The recording unit 86 is a so-called multi-head type recording unit having a plurality of recording heads #1-#n (see FIG. 12A) extending over a maximum width of the recording paper sheet P. A control apparatus 87 illustrated in FIG. 10 drives a transport motor 88, thereby transporting the recording paper sheet P on the transport belt 84 downstream in the transport direction Y (leftward in FIG. 10) at a constant speed. The recording heads #1-#n in the recording unit 86 eject ink drops to the recording paper sheet P. The printing of the recording paper sheet P is thus performed. A linear encoder 89 is arranged at one edge of the transport belt 84. The ejection timing of the recording heads #1-#n is controlled in accordance with an ejection timing signal generated from an encoder pulse output from a sensor 90 in the linear encoder 89.

Such a line printer includes a plurality of controllers C#1-C#n in the control apparatus 87. The controllers C#1-C#n are electrically connected to the recording heads #1-#n in the recording unit 86. The head system 20 is thus constructed.

Figure 12A:
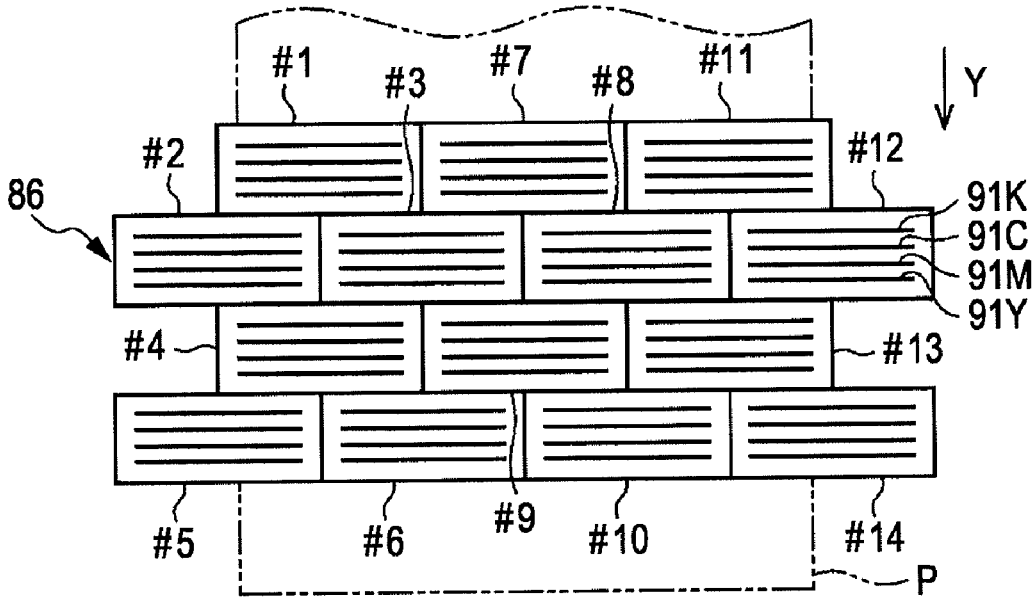
FIG. 12A is a bottom view of a head unit.

The recording head layout and nozzle layout in the head system 20 are described below with reference to FIGS. 12A and 12B. FIG. 12A is a bottom view of the recording head layout of the head system 20. Referring to FIG. 12A, the recording unit 86 includes a plurality of the recording heads #1-#n (14 heads with n=14 here) arranged in a plurality of lines (four lines here) in a zigzag configuration. Each of the recording heads #1-#n includes on the nozzle opening surface thereof four rows of nozzles, one row for each of ink colors (K, C, M, and Y), i.e., four nozzle rows of 91K, 91C, 91M, and 91Y. The plurality of nozzle rows 91K, 91C, 91Y, and 91Y in the recording heads #1-#n in the zigzag configuration cover the maximum width of the recording paper sheet P.

Figure 12B:
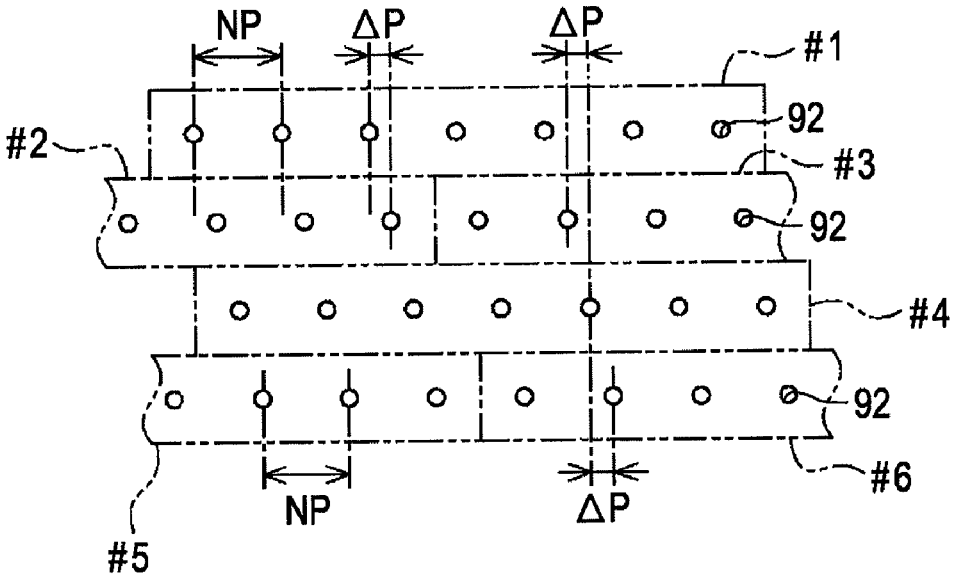
FIG. 12B illustrates a nozzle position of a recording head.

FIG. 12B diagrammatically illustrates the positional relationship of the nozzles of the recording heads. It is noted that FIG. 12B illustrates only one nozzle row (for one color of the four colors) of the four nozzle rows in the recording head. The recording heads #1-#n in the four lines have the same nozzle pitch NP, and the nozzles of one line are shifted from the nozzle of a next line by AP equal to a quarter of the nozzle pitch NP in the direction of the nozzle line (in a direction perpendicular to the paper transport direction, i.e., in a paper width direction). More specifically, the nozzles of the recording heads #2 and #3 in the second line are shifted rightward in position from the nozzles in the recording head #1 in the first line by ΔP equal to a quarter of the nozzle pitch NP as shown in FIG. 12B. The nozzles of the recording head #4 in the third line are further shifted rightward in position by ΔP and the nozzles of the recording heads #5 and #6 in the fourth line are even further shifted rightward in position by ΔP. With this arrangement, the recording heads #1-#n can form dots in complemented positions within the paper width. The printer 13 can thus print at a printing resolution four times as high as the resolution determined by the nozzle pitch NP.

The line printer includes a plurality of recording heads, arranged in the transport direction Y, printing the same portion of the paper to be transported. With reference to FIG. 12A, six recording heads #1-#6 satisfy the condition that the nozzle lines partly overlap if viewed from the transport direction (condition that it is not necessary for the nozzles to overlap each other and that it is not necessary for the same lines to overlap each other). Here, m recording heads satisfying the condition that the nozzle lines overlap partly each other if viewed from the transport direction become a group of recording heads in a data sharing relationship. The controllers C#1-C#m corresponding to the group of recording heads in the data sharing relationship cooperate each other in the generation of the ejection data in response to the delivered distribution data (however, the generation of the ejection data is carried out by the CPU 18), and in feeding the generated ejection data.

Figure 11:
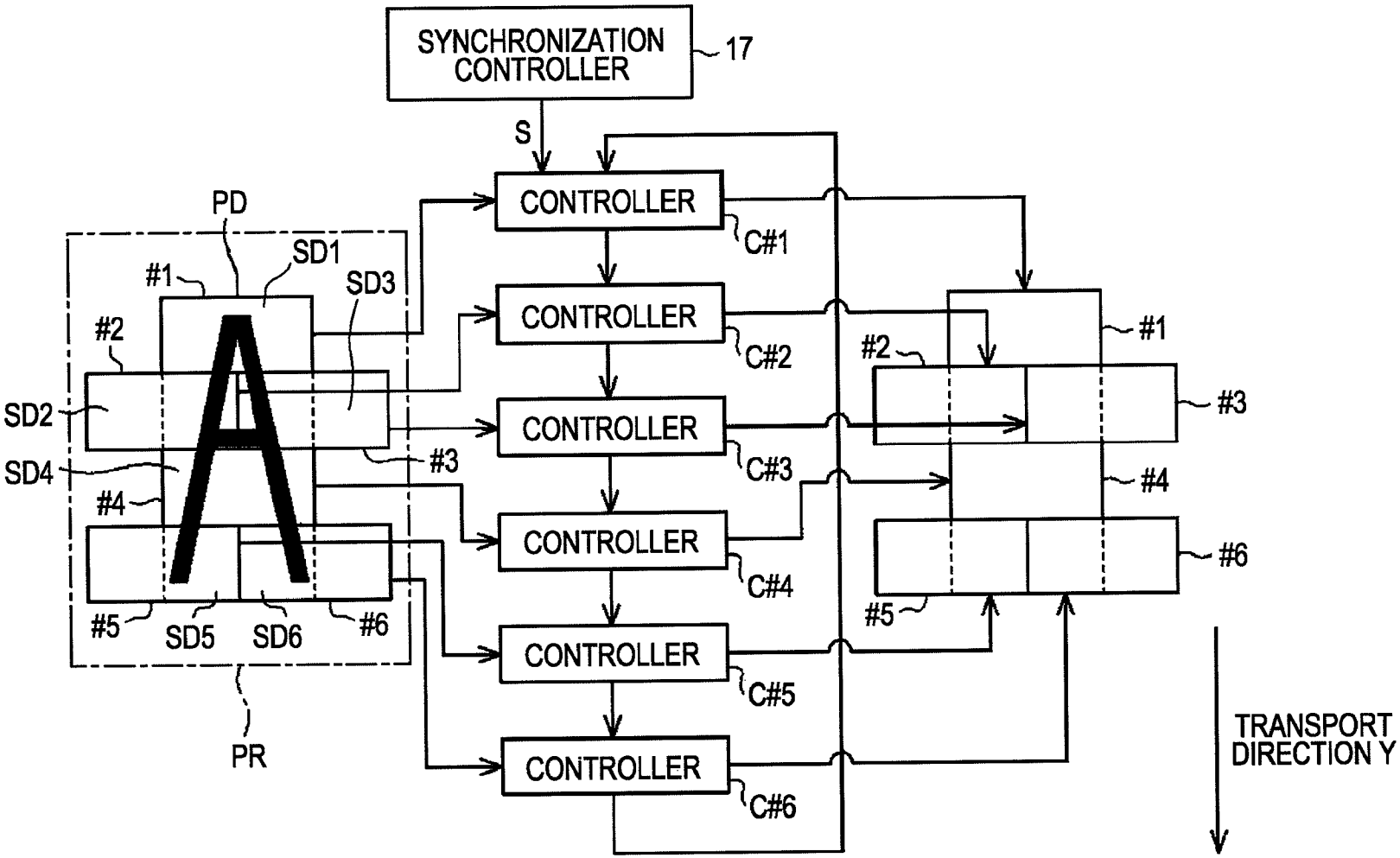
FIG. 11 diagrammatically illustrates a head component system in the line printer.

FIG. 11 illustrates the printing process of the line printer. For simplicity of explanation, an image having a size printable with the six recording heads #1-#6 is printed. For this reason, FIG. 11 illustrates only the six recording heads #1-#6.

Referring to FIG. 11, the printer driver PR sends the print data PD to the printer 13 on a per unit basis. A unit of print data PD means dot data covering a recording range printable within a period throughout which the recording paper sheet P is transported by a distance equal to the length of the nozzle group of the recording heads #1-#n in the transport direction (equal to the distance from the most upstream nozzle to the most downstream nozzle).

The communication interface 15 divides the print data PD into the n (14) units of distribution data SD1-SDn in accordance with the recording heads #1-#n, and sends (distributes) the distribution data SD1-SDn to the controllers C#1-C#n. With reference to FIG. 11, the distribution data SD1-SD6 are distributed to the controllers C#1-C#6, respectively. In this case, null data may be distributed to the controllers C#7-C#n corresponding to the recording heads #7-#n having no image to record.

The controllers C#1-C#6 transfer the received distribution data SD1-SD6 to the CPU 18 (see FIGS. 1, 3 and 4). In the data generation process, the CPU 18 generates the ejection data for the recording heads #1-#6 in response to the distribution data. A plurality of units of ejection data that the CPU 18 generates in response to the distribution data SDk (k=1, . . . , n) are limited to the ejection data Dk1-Dkm for m recording heads #1-#m in the data sharing relationship. In the case of the line printer, a plurality of group, each group including m recording heads in the data sharing relationship, may be arranged in the paper width direction. For example, the recording unit 86 illustrated in FIG. 12A includes three groups of six controllers, each group corresponding to a group of recording heads in which the nozzle lines partly overlap each other if viewed from the transport direction Y. The three groups include a first group of controllers C#1-C#, a second group of controllers C#7, C#3, C#8, C#9, C#6, and C#10, and a third group of controller C#11, C#8, C#12, C#13, C#10, and C#14. The ejection data generation process is performed on a per group basis.

The group of controllers C#1-C#6 illustrated in FIG. 11 is now considered. The m (six) units of ejection data D11-D1*m* for the recording heads #1-#6 are generated from the distribution data SD1. As for the recording heads #2, #3, #5, and #6, about half the nozzles thereof are used in printing, and the ejection data for a printing area only is thus generated. The CPU 18 attaches to each of ejection data Dk1-Dkm a head containing the transfer source address and the transfer destination address. In designate Dij representing the ejection data, the letter "i" represents the transfer source address "#i" and the letter "j" represents the transfer destination address "#j." The CPU 18 returns each ejection data of m units, D11-D1*m*, . . . , Dm1-Dmm, to the controllers as the transfer sources. The transfer buffer 51 in the controller C#k stores m units of ejection data Dk1-Dkm (see FIG. 4).

The controllers C#1-C#6 relay-transfer the ejection data for the other controllers in directions denoted by arrows in FIG. 11. In the case of the line printer, adjacent groups of recording heads share some of the recording heads. For example, the first group of recording heads #1-#6 and the second group of recording heads #7, #3, #8, #9, #6, and #10 share recording heads #3, and #6. The second group of controllers #7, #3, #8, #9, #6, and #10 and the third group of recording heads #11, #8, #12, #13, #10, and #14 share recording heads #8 and #10. The controllers C#3, C#6, C#8 and C#10 corresponding to the recording heads shared by two groups are so arranged that the transfer is possible between the two groups including those controllers.

More specifically, the first group of controllers C#1-C#6 is cascade-connected to allow data transfer in a circulation path as illustrated in FIG. 11. The second group of controllers C#7, C#3, C#8, C#9, C#6, and C#10 is cascade-connected and the third group of controller C#11, C#8, C#12, C#13, C#10, and C#14 is cascade-connected to allow data transfer in a circulation path. The controllers C#3 and C#6 belonging to the two groups and the controllers C#8 and C#10 belonging to the two groups have transfer paths connected to each other. The controllers C#3, C#6, C#8, and C#10 are connected to the other controllers in the two groups via two signal lines 34. For example, the controllers C#3 and C#6 shared by the first and second groups belong to two transfer paths of a first transfer path C#1→C#2→C#3→C#4→C#5→C#6→C#1→ . . . and a second transfer path C#7→C#3→C#8→C#9→C#6→C#10→C#7→ . . . .

In the example having six transfer target controllers illustrated in FIG. 11, the transfer speed of the signal lines 34, each connecting the controllers C#1-C#6, is preferably defined as (a predetermined transfer speed achieved between two controllers (transfer speed of the small-data block))×(number of transfer target controllers ("6" in FIG. 11))/2. The large-data block having a predetermined size is transferred through the signal line 34. The large-data block is divided into slots of the number equal to the value of the number of transfer target controllers/2 (3 slots in the present embodiment). Since the transfer speed of the signal line 34 and the number of slots in the large-data block are determined depending on the number of transfer target controllers, a required transfer time remains short even if the number of transfer target controllers increases. A delay in the ejection timing is thus controlled.

Although the number of controllers per group is increased to six, the relay transfer is similarly performed in accordance with the rule illustrated in FIG. 5. Before the start of the transfer, the transfer buffer 51 in the controller C#k stores six units of ejection data #k→#1, #k→#2, #k→#3, #k→#4, #k→#5, and #k→#6. Each time the transfer is performed, the delivery destination counter 53 changes the count thereof as the transfer destination address in the order of #6→#5→ . . . →#1→#6→ . . . . The rest of the transfer rule is identical to the previously discussed one. When the count of the transfer operation counter 57 reaches "6" with six transfer operations completed, the ejection data for the first recording operation is circulated across the controllers C#1, C#7, and C#11 corresponding to the recording heads that are to perform the recording operation first, i.e., the recording heads (reference numerals #1, #7 and #11 in FIG. 12) at the most upstream positions. The ejection data is then sent to the recording heads #1-#6.

Figure 13:
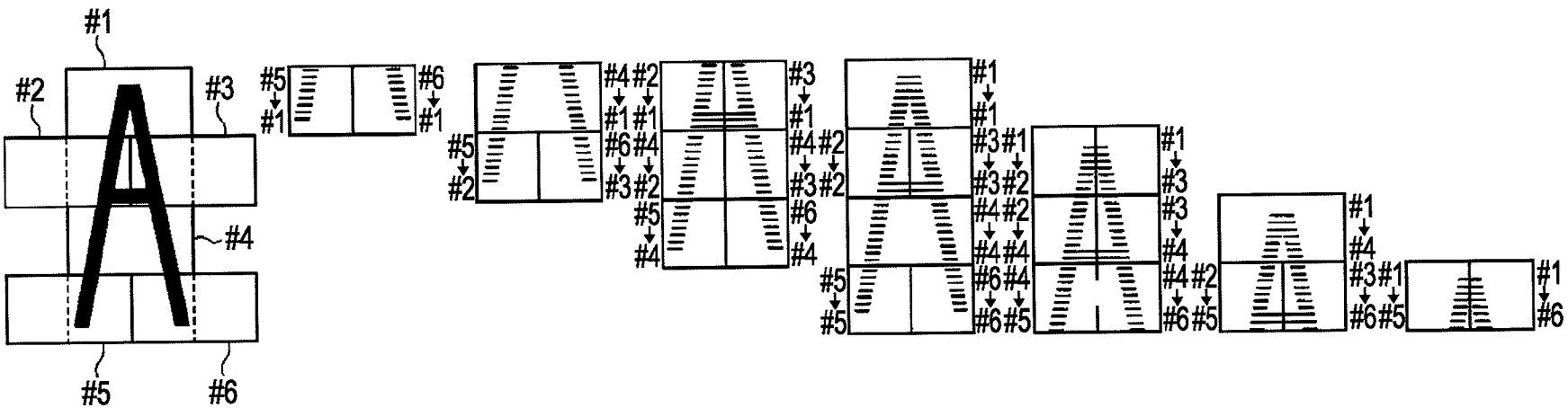
FIG. 13 diagrammatically illustrates a transfer process of ejection data of the line printer.

FIG. 13 illustrates the ejection data to be sent to the recording heads #1-#6 in the relay transfer. The output order counter 58 (see FIG. 4) here is a dual counter that counts two values at a time, and more specifically outputs the counts in the order of (5,6)→(4,4)→(2,3)→(1,1).

With the six transfer operations completed, the ejection data "#5→#1" and "#6→#1" have been transferred to the controller C#1. When the count of the transfer operation counter 57 reaches the predetermined value "6," the ejection data "#5→#1" and "#6→#1" having the counts "5" and "6" of the output order counter 58 as the transfer source addresses are sent to the recording head #1 at the first line. Null data or no data is sent to the recording heads in the second and subsequent lines not performing the recording operation yet.

When it is a first row ejection timing with the recording paper sheet P having reached a print start position, the recording head #1 in the first line starts the ejection operation of ink drops in response to the ejection data "#5→#1" and "#6→#1" having #5 and #6 at the fourth line as the transfer source address. As a result, while the recording paper sheet P is transported to a position Y1 in FIG. 14, the recording head in the first line performs the recording operation on the recording paper sheet P at the position Y1.

In the meantime, a next transfer operation is performed. The ejection data "#4→#1" is transferred to the controller C#1, the ejection data "#5→#2" is transferred to the controller C#2, and the ejection data "#6→#3" is transferred to the controller C#3. The ejection data having as the transfer source address the count at the output order counter 58 is then sent to the recording heads. More specifically, the ejection data "#4→#1" is sent to the recording head #1 in the first line, the ejection data "#5→#2" and the ejection data "#6→#3" are sent to the recording head #2 and the recording head #3 in the second line, respectively. Null data or no data is sent to the recording heads in the third and subsequent lines that are not to perform the recording operation at this point of time.

Figure 14:
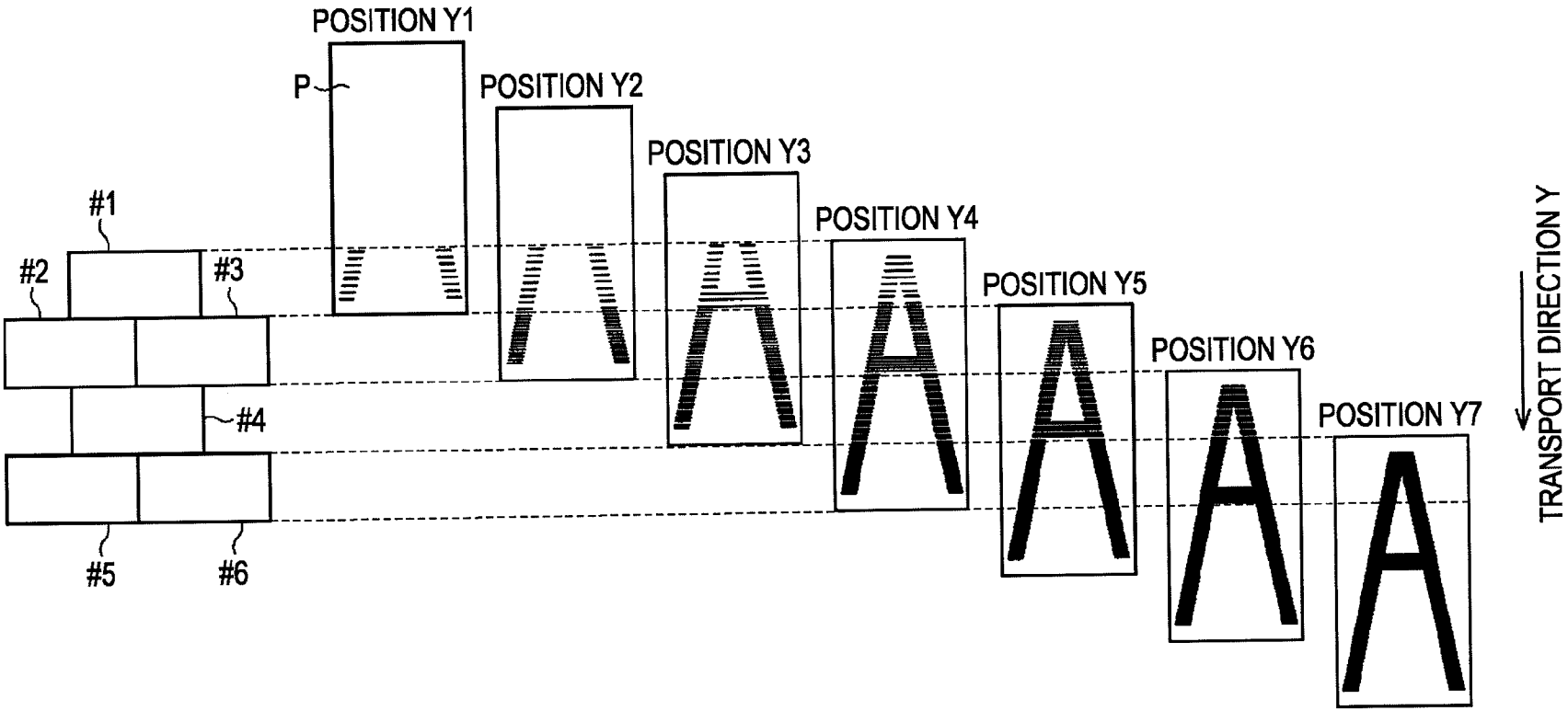
FIG. 14 diagrammatically illustrates a printing process of the line printer.

When the recording heads #2 and #3 in the second line reach the ejection timing for starting the recording operation, the ink ejection operation of the recording head #1 in the first line is performed in response to the ejection data "#4→#1" having #4 in the third line as the transfer source. The ink ejection operations of the recording heads #2 and #3 in the second line are performed in response to the ejection data "#5→#2" and "#6→#3" having #5 and #6 in the fourth line as the transfer sources. These ink ejection operations are concurrently started. As a result, while the recording paper sheet P is transported from the position Y1 to position Y2 as illustrated in FIG. 14, the recording heads #1-#3 in the first and second lines perform the recording operation, thereby printing the position Y2 on the recording paper sheet P.

In the meantime, a next transfer is in progress. The ejection data "#2→#1" and "#3→#1" are transferred to the controller C#1. The ejection data "#4→#2" and "#4→#3" are transferred to the controllers C#2 and C#3, respectively. The ejection data "#5→#4" and "#6→#4" are transferred to the controller C#4. The ejection data having as the transfer source address the count at the output order counter 58 is sent to the recording heads. More specifically, as illustrated in FIG. 13, the ejection data "#2→#1" and "#3→#1" are sent to the recording head #1 in the first line. The ejection data "#4→#2" and "#4→#3" are sent to the recording heads #2 and #3 in the second line, respectively. The ejection data "#5→#4" and "#6→#4" are sent to the recording head #4 in the third line. Null data or no data is sent to the recording heads in the fourth line that are not to perform the recording operation at this point of time.

When the recording heads #4 in the third line reaches the ejection timing for starting the recording operation, the ink ejection operation of the recording head #1 in the first line is performed in response to the ejection data "#2→#1" and "#3→#1" having #2 and #3 in the second line as the transfer sources. The ink ejection operations of the recording heads #2 and #3 in the second line are performed in response to the ejection data "#4→#2" and "#4→#3" having #4 in the third line as the transfer sources. The ink ejection operations of the recording heads #2 and #3 in the third line are performed in response to the ejection data "#5→#4" and "#6→#4" having #5 and #6 in the fourth line as the transfer sources. These ink ejection operations are concurrently started. As a result, while the recording paper sheet P is transported from the position Y2 to position Y3 as illustrated in FIG. 14, the recording heads #1-#4 in the first through third lines perform the recording operation, thereby printing the position Y3 on the recording paper sheet P.

After a next transfer operation, the ejection data "#1→#1" is sent to the recording head #1 in the first line as shown in FIG. 13. The ejection data "#2→#2" and "#3→#3" are sent to the recording heads #2 and #3 in the second line, respectively. The ejection data "#4→#4" is sent to the recording head #4 in the third line. The ejection data "#5→#5" and "#6→#6" are sent to the recording heads #5 and #6 in the fourth line, respectively. While the recording paper sheet P is transported from the position Y3 to position Y4, the recording heads #1-#6 in the first through fourth lines perform the recording operation, thereby printing at position Y4 on the recording paper sheet P.

Each time the transfer process advances by one transfer operation, the ejection data illustrated in FIG. 13 is sent to the recording heads, and the printing is performed at each position as illustrated in FIG. 14 with the recording paper sheet P being transported. The six recording heads #1-#6 are considered with reference to FIGS. 11, 13 and 14. As for the remaining recording heads #7-#n, the distribution process of the distribution data, the ejection data generation process, the relay transfer process, etc. are also performed on a per group basis with each group including six recording heads. The line printing is thus performed on a per recording head group basis. FIGS. 13 and 14 diagrammatically illustrate that the dot complementation is performed by forming dots in positions shifted in the transport direction Y. In practice, however, the dot complementation is performed by forming the dots in positions shifted in the paper width direction (lateral direction in FIGS. 13 and 14) as clear from the nozzle position illustrated in FIG. 12B.

The embodiments of the invention provide the advantages described below.

The printer 13 is constructed by employing a plurality of head component units 19, which is common to the serial printer and the line printer. Even if the number of recording heads to be arranged to cover the maximum width of the recording paper is different due to a size difference in the line printer, the use of the appropriate number of head component units 19 can overcome the problem. More specifically, it is not necessary to develop and manufacture different printer drivers for printers different in the number of recording heads. The printer driver PR simply sends the print data PD to the printer or simply sends the print data PD after a simple process in which the print data PD is divided into the distribution data and the destination of the distribution data is specified. Once the print data PD is sent, the printer 13 performs the distribution process of the distribution data to each controller, the data generation process of generating the ejection data for the recording heads #1-#n from the distribution data, and the transfer process of transferring the ejection data to the appropriate controller. The appropriate ejection data is thus output to the recording heads. The printer driver PR is thus free from any major modification even if the printer is different in type and recording method.

Improvements in the ease of system configuration and cost reduction to the known system are provided in addition to the flexibility of the printer head arrangement. For example, in known star-configuration systems in which a plurality of controllers are connected to a data exchange unit, the data exchange unit is necessary, and the connection lines to the data exchange unit tend to become longer. In accordance with the embodiments of the invention, the data exchange unit becomes unnecessary, and relatively short connection lines are sufficient. In known bus-configuration systems in which a plurality of controllers are connected to a bus, bandwidth of the system tends to be narrower due to bus contention. In accordance with the embodiments of the invention, a necessary bandwidth is easy to obtain because no bus contention is present. In known all-to-all configuration systems in which each of the controllers C#1-C#n is connected to all the remaining controllers, the number of transfer operations is minimized (for one transfer operation) because a direct transfer to a destination controller is possible. However, an increase in the surface area of each board and a complex wiring of the board are problematic. The embodiments of the invention are free from such a wide board area problem and complex wiring board problem.

Since the rule in the transfer process between the controllers remains unchanged between the serial printer and the line printer, components common to the controller C in the serial printer and the controller C in the line printer may be used.

The delivery destination counter 53 specifies the destination of the ejection data to be transferred in the order (#n→ . . . →#2→#1) reverse to the transfer order of the controllers (the order of the controller reference numbers "C#1→C#2→ . . . →C#n). The relay transfer is performed in the specified order. The number of transfer operations before necessary ejection data reaches all the controllers is minimized (to a constant value). As a result, the number of transfer operations is minimized in response to the number of transfer target controllers even if the number of transfer target controllers is large. This arrangement prevents the recording head from delaying the ejection operation.

The number of transfer operations needed to cause the ejection data for the first recording to reach the corresponding controller is a constant value. The moment the transfer operation count value of the transfer operation counter 57 reaches the predetermined value (constant value) may be set as a record start timing. This arrangement eliminates the need for a complex process in which the completion of the transfer of the ejection data to the corresponding controller is detected by checking destination information of the ejection data. In accordance with the embodiments of the invention, the record start timing is detected by simply managing the count of the transfer operation counter 57. This arrangement is free from a complex verification process and allows the recording head # to start recording at an appropriate record start timing.

The first controller C#1 is connected to the terminal controller C#n via the signal line 34 so that the ejection data is transferred from the terminal controller C#n to the first controller C#1. The relay transfer of circulating the ejection data through the controllers C#1-C#n is thus performed. The printer 13 can support interlace printing in the serial printer and dot complementation printing such as line printing in the line printer.

The transfer target controllers of one group are connected via the signal line 34 (transfer path) having a transfer speed defined by (a predetermined transfer speed achieved between two controllers (transfer speed of the small-data block))×(the number of transfer target controllers)/2. The large-data block having a predetermined size to be transferred through the signal line 34 is divided into slots of the number equal to the number of transfer target controllers/2. Each slot accommodates the ejection data having the destination of the destination controller. Since the slots of the number responsive to the number of transfer target controllers are prepared, the necessary transfer time is kept to within a predetermined range even if the number of transfer target controllers increases.

The invention is not limited to the above-described embodiments.

First Modification

In the above-described embodiments, the relay transfer is performed in a single direction through the controllers C#1-C#n. Alternatively, the ejection data may be transferred in dual directions through the controllers C#1-C#n. More specifically, the controllers C#1-C#n are connected via dual-direction signal lines so that the relay transfer is performed in dual directions. The ejection data can thus be transferred in mutually opposite directions through the controllers C#1-C#n. Each of the controllers C#1-C#n includes two pairs of receiving and transmitting units to enable the dual-direction transfer. The data size per transfer operation may be the small-data block equal to one unit of ejection data, or the large-data block equal to two units of ejection data. With the dual-direction transfer method employed, the required number of transfer operations before the start of the recording operation is reduced, and the waiting time before the start of the recording operation is shortened. The printing can be quickly started.

Second Modification

The invention is not limited to the relay transfer in which the transfer is performed one controller by one controller. For example, a plurality of controllers may be connected to a common bus, and the controllers C#1-C#n transfer the ejection data to a specified destination via the bus in a single transfer operation.

Third Modification

The verification unit for verifying the completion of the transfer establishing the record start condition is not limited to the one that responds to the countup signal output when the transfer operation counter 57 reaches the predetermined value. For example, the controller corresponding to the recording head performing the first recording operation may check the transfer source address of the ejection data addressed to own address, and then verifies that the transfer operation needed to start the recording is complete.

Fourth Modification

The specifying order of the destinations of the ejection data to be transferred is not limited to the direction reverse to the transfer direction. The specifying order of the destinations may be to be any order as long as the number of transfer operations before the start of the recording is limited to a small number (m or smaller, for example) and as long as all the next ejection data is ready at each transfer operation. The destination specified first may be not be #m, or may be updated in a random fashion on condition that the same destination as the one previously specified is not selected in the specifying order of the destinations. The same destination may not be specified for all the controllers C#1-C#n and a different destination may be specified for each of the controllers C#1-C#n.

Fifth Modification

The relay transfer direction for transferring the ejection data one controller by one controller is not limited to ascending order from the controller C#1 corresponding to the recording head at the most upstream position in the transport direction to the controller #m corresponding to the recording head at the most downstream position in the transport direction. For example, the relay transfer direction may be aligned with descending order from the controller #m corresponding to the recording head at the most downstream position in the transport direction to the controller C#1 corresponding to the recording head at the most upstream position in the transport direction. In other words, the ejection data may be transferred to a controller corresponding to a recording head to record later in time to a controller corresponding to a recording head to record earlier in time. It is important that the transfer process is complete before the execution of the recording operation.

Sixth Modification

The recording head is not limited to one of the plurality of recording heads. A single and long recording head may be divided into a plurality of head zones, each head zone including a plurality of nozzles, and each head zone may be used as a recording head. In this case, a plurality of controllers are arranged for the plurality of head zones on the single recording head.

Seventh Modification

The data generator is not limited to the CPU 18 that executes a program for the data generation process. For example, the controllers C#1-C#n may serve as the data generator, and the controller C#k may generate the ejection data Dk1-Dkm in response to the distribution data SDk.

Eighth Modification

The division of the print data into the distribution data is not limited to the distribution data having no overlapping portion. The print data may be divided into a plurality of units of distribution data mutually overlapping in a portion in the vicinity of the border therebetween.

Ninth Modification

In the above-described embodiments, the head component unit 19 is constructed with one controller corresponding to one recording head. Alternatively, a plurality of recording heads may correspond to a single controller. For example, the head component unit 19 may be constructed with two recording heads #2*k*-1 and #2*k*-2 corresponding to a single controller C#k (k=1, 2, . . . , n). Furthermore, the head component unit 19 may be constructed with four recording heads #4*k*-3, #4*k*-2, #4*k*-1, and #4*k* corresponding to a single controller C#k (k=1, 2, . . . , n). In such a case, the processor circuit may be arranged on a per recording head basis to perform the transfer process between the controllers.

Tenth Modification

The interlace printing of the serial printer is not limited to a recording method in which the main scan line is shifted in position on a per recording head basis. For example, nozzles arranged in a pitch equal to an integer multiple of the dot pitch in the sub scan direction are used. After one main scan, the recording head group and the recording paper sheet P are relatively moved in the sub scan direction by a distance equal to an integer mutually disjoint to the dot pitch and the main scan operation is then performed.

Eleventh Modification

In the serial printer, the invention is not limited to the ink jet recording method. The invention is applicable to a dot impact recording method or a thermal transfer recording method.

Twelfth Modification

The recording apparatus is not limited to a printer. The recording apparatus may be applied to a fluid ejection recording apparatus that ejects a fluid other than ink. For example, the word "recording" refers to an operation for ejecting on a circuit board a fluid containing a material having a predetermined characteristic in order to draw a wiring pattern and an image on the circuit board. The recording apparatus may be a fluid ejection apparatus for ejecting a fluid in which a material such as an electrode material or a color material is dispersed or dissolved. The fluid ejection apparatus may be used to manufacture a liquid-crystal display, an electroluminescent (EL) display, a surface emission display, etc.

In accordance with the above-described embodiments and modifications, arrangements described below also fall within the scope of the invention.

The data generator generates the recording data in response to the distribution data so that the recording head corresponding to the controller records dots in different positions on the target.

The verification unit verifies that the transfer operation has been completed. In the transfer operation, the recording data for the first recording has reached the controller corresponding to one of at least two recording heads that is to perform the first recording.

What is claimed is:

1. A recording system for performing a recording operation on a target, comprising:

a plurality of recording heads;

a plurality of controllers that are arranged respectively for the plurality of recording heads; a data distributor that distributes a second data to each of the controllers, the second data resulting from dividing, by the number of recording heads, a first data to be supplied; and a data generator that generates a third data to be output respectively to the plurality of recording heads in response to the second data, wherein each controller includes:

a transfer unit that transfers the third data to be output to the recording head corresponding to another controller to the other controller;

a verification unit that verifies that a record start condition is established, the record start condition is established in a state that a number of transfer operations has reached a predetermined value; and an execution unit that causes the respective recording head to start executing the recording operation in response to the third data if the establishment of the record start condition is verified.

2. The recording system according to claim 1, wherein each transfer unit sequentially transfers the third data through the controllers from one controller to a next controller in a transfer path that cascade-connects the plurality of controllers, and includes a transfer synchronization unit that synchronizes the transfer operation of the transfer unit with the transfer operation of the transfer unit of the other controller;

wherein each verification unit includes a counter that counts the number of the transfer operation times;

wherein the execution unit causes the recording head to start executing the recording operation in response to the third data when the transfer operation count of the counter reaches the predetermined value.

3. The recording system according to claim 2, wherein each controller further comprises a transfer data selector, wherein the transfer data selector selects the third data to be transferred by specifying a destination controller for the third data, in a manner such that a transfer direction of the third data sequentially transferred from one controller to a next controller in order is reverse to a destination change direction in which the destination controller is changed in order.

4. The recording system according to claim 3, wherein the controllers are connected via the transfer path having a transfer speed determined by dividing by 2 the product of a predetermined transfer speed achieved between two controllers and the number of transfer target controllers;

wherein the third data is transferred by a large-data block having a predetermined size transferrable by the transfer path, and the large-data block is split into slots, each slot accommodating the number of units of third data equal to the value determined by dividing by 2 the number of transfer target controllers;

wherein the slot accommodates the third data having an address of a destination controller;

wherein the transfer unit includes a receiver that receives the third data and a transmitter that transmits the third data; and wherein each controller further includes:

an own data acquisition unit that determines whether the third data addressed to own address is contained in the large-data block received by the receiver, and acquires the record data addressed to own address if the third data addressed to own address is contained; and a transfer data storage unit that removes from the slot the third data addressed to own address if the record data addressed to own address is contained in the long-data block received by the receiver when the large-data block received by the receiver is transmitted to the transmitter, and stores the third data addressed to a destination specified by the transfer data selector in an empty slot if the large-data block contains the empty slot and then sends the large-data block to the transmitter.

* * * * *